US007895858B2

(12) United States Patent
Hell et al.

(10) Patent No.: US 7,895,858 B2
(45) **Date of Patent: *Mar. 1, 2011**

(54) MODULAR REFRIGERATING APPLIANCE

(75) Inventors: Erich Hell, Giengen (DE); Michael Neumann, Munich (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 497 days.

This patent is subject to a terminal disclaimer.

(21) Appl. No.: 11/666,539

(22) PCT Filed: Oct. 12, 2005

(86) PCT No.: PCT/EP2005/055193

§ 371 (c)(1),
(2), (4) Date: Apr. 27, 2007

(87) PCT Pub. No.: WO2006/045700

PCT Pub. Date: May 4, 2006

(65) Prior Publication Data

US 2009/0044558 A1 Feb. 19, 2009

(30) Foreign Application Priority Data

Oct. 29, 2004 (DE) ..... 10 2004 052 624

(51) Int. Cl.

| | |
|---|---|
| ***F25D 19/00*** | (2006.01) |
| ***F25D 11/00*** | (2006.01) |
| ***F25D 11/02*** | (2006.01) |
| ***F25D 23/00*** | (2006.01) |
| ***G01K 13/00*** | (2006.01) |
| ***A47F 3/04*** | (2006.01) |
| ***A47B 47/00*** | (2006.01) |
| ***A47B 96/04*** | (2006.01) |

(52) U.S. Cl. ..... 62/298; 62/440; 62/443; 62/129; 62/264; 62/441; 312/116; 312/400; 312/401; 312/405; 312/406.2; 312/263

(58) Field of Classification Search ..... 62/129, 62/264, 441, 298, 440, 406.2, 263, 443; 312/116, 312/400, 401, 405, 406.2, 263
See application file for complete search history.

(56) References Cited

U.S. PATENT DOCUMENTS 2,768,508 A * 10/1956 Guyton ..... 62/509

(Continued)

FOREIGN PATENT DOCUMENTS

DE 84 15 798 U 9/1985

(Continued)

OTHER PUBLICATIONS

International Search Report PCT/EP2005/055193.

(Continued)

*Primary Examiner* — Thomas E Denion
*Assistant Examiner* — Michael Carton
(74) *Attorney, Agent, or Firm* — James E. Howard; Andre Pallapies

(57) ABSTRACT

A modular refrigerating appliance comprising a first planar heat-insulating element and additional planar heat-insulating elements, which are joined to one another whereby being able to be detached from one another and which, when joined, form a housing of the refrigerating appliance. The modular refrigerating appliance also has a cooling circuit, which comprises an evaporator, a condenser, and a compressor, and which is mounted on the first planar heat-insulating element. At least the condenser is, at least in part, mechanically protected on its surface facing away from the first heat-insulating element solely by the construction of the first planar heat-insulating element.

30 Claims, 17 Drawing Sheets

U.S. PATENT DOCUMENTS

Figure 1:
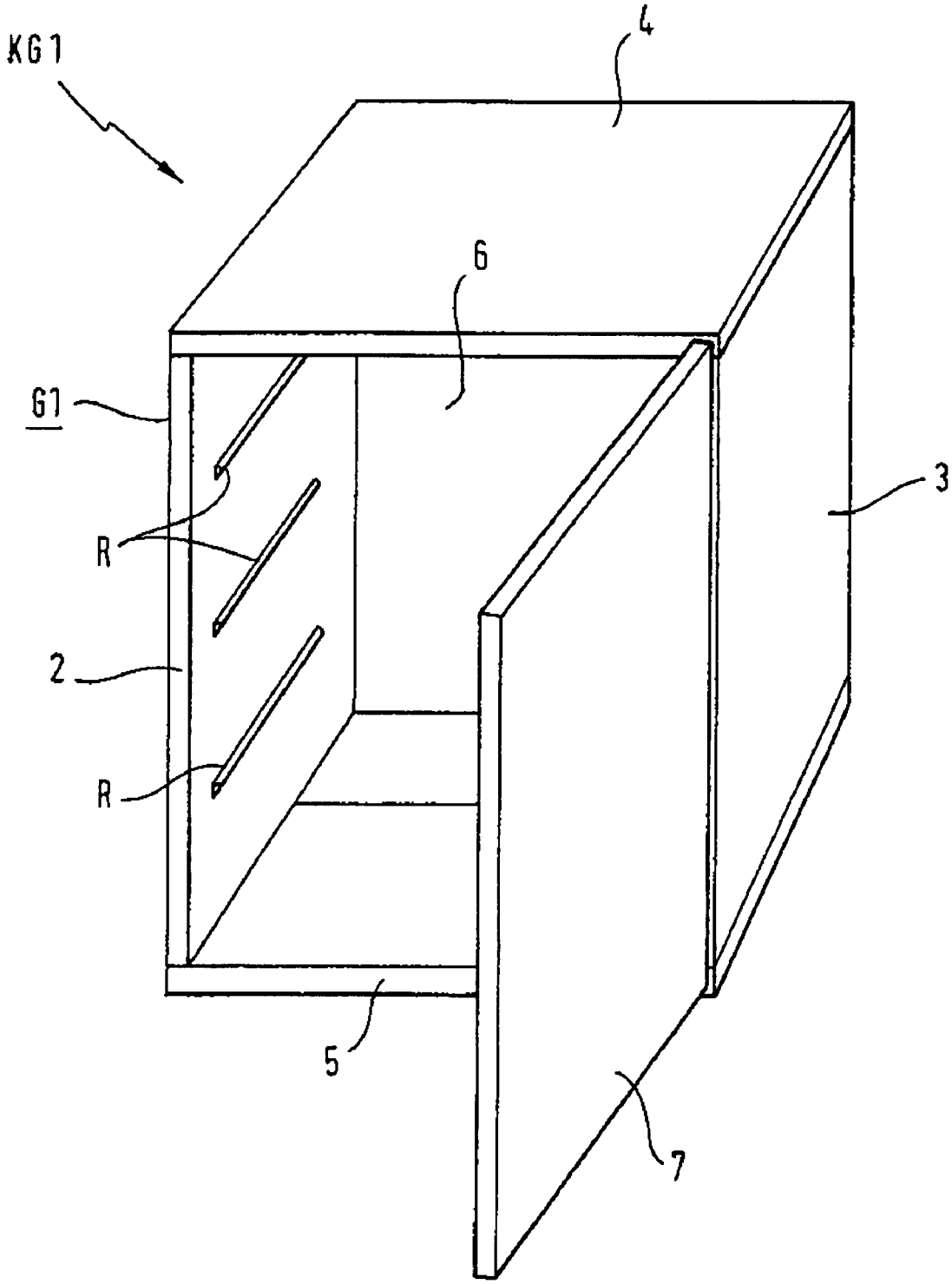

| | | | | | |
|---|---|---|---|---|---|
| 3,349,220 | A | * | 10/1967 | Kinney | 219/218 |
| 3,902,332 | A | | 9/1975 | Torcomian | |
| 4,196,950 | A | * | 4/1980 | Churchill et al. | 312/406 |
| 4,917,256 | A | * | 4/1990 | Kruck et al. | 220/4.28 |
| 5,921,095 | A | * | 7/1999 | Lee et al. | 62/175 |
| 6,238,032 | B1 | * | 5/2001 | Cooper et al. | 312/401 |
| 2004/0134221 | A1 | * | 7/2004 | Fee et al. | 62/448 |
| 2006/0144058 | A1 | | 7/2006 | Kentner et al. | |

FOREIGN PATENT DOCUMENTS

| | | | | |
|---|---|---|---|---|
| FR | 2 674 617 | | | 10/1992 |
| WO | WO2004062444 | A2 | * | 7/2004 |
| WO | WO 2005/090884 | | | 9/2005 |

OTHER PUBLICATIONS

National Search Report 10 2004 052 624.9.

* cited by examiner

MODULAR REFRIGERATING APPLIANCE

The invention relates to a modular refrigerating appliance comprising a first planar heat-insulating element and additional planar heat-insulating elements which are joined to one another and can also be detached from one another again and, when joined, form a housing of the refrigerating appliance. The refrigerating appliance also has a cooling air circuit which comprises an evaporator, a condenser and a compressor and which is mounted on the first planar heat-insulating element.

Such a modular refrigerating appliance is disclosed, for example, in DE 84 15 798 U1. This modular refrigerating appliance consists of two replaceable lateral walls, a rear wall, a ceiling wall, a bottom wall and a front door which are fastened to each other by fastening and joining means. The lateral walls, the rear wall, the ceiling wall and the bottom wall are each manufactured as a complete unit, are fixed to each by means of screws, for example, and form the housing of the refrigerating appliance. A compressor, a condenser, a thermostat and a throttle valve of the refrigerating appliance are all fastened to the rear wall, the condenser being mounted on the flat outer surface of the rear wall. Because the condenser is fastened to the flat outer surface of the rear wall it projects and may therefore be damaged relatively easily, particularly during transport of the rear wall.

The object of this invention is therefore to construct a modular refrigerating appliance in such a manner that the possibility of damage to the cooling circuit and, in particular the evaporator and condenser, is reduced in during transport of the rear wall of the modular refrigerating appliance.

The object of the invention is achieved by a modular refrigerating appliance comprising a first planar heat-insulating element and additional planar heat-insulating elements which can be joined to one another and detached from one another again, and which, when joined, form a housing of the refrigerating appliance, and also having a cooling circuit which comprises an evaporator, a condenser and a compressor and which is mounted on the first planar heat-insulating element, characterised in that solely by the construction of the first planar heat-insulating element at least the condenser is, at least in part, mechanically protected on its surface facing away from the first planar heat-insulating element. The modular refrigerating appliance according to the invention is designed, in particular, to be delivered to an end consumer or an end user in the non-assembled, i.e. dismantled condition, so that he or she is able to assemble the planar heat-insulating elements, which comprise, for example, two lateral elements, a bottom element, a ceiling element and a rear wall, to form a functional refrigerating appliance. However, planar heat-insulating elements may also be a combination of a lateral element and a ceiling element, for example, i.e. a planar heat-insulating element is part of the housing of the refrigerating appliance. The individual planar heat-insulating elements and, in particular, the first planar heat-insulating element, advantageously comprise an inner lining and an outer lining which enclose a cavity filled with a heat-insulating material. Because at least the condenser is mechanically protected solely by the construction of the first heat-insulating element, the risk of damage to the condenser, in particular, during transport of the rear wall is reduced. Because the entire cooling circuit is mounted on the first heat-insulating element, the circuit can already be filled with the required refrigerant, tested and delivered in a functional condition before delivery of the individual planar heat-insulating elements.

The condenser is protected extremely well when it is provided according to a preferred embodiment of the modular refrigerating appliance according to the intention in which is integrated the first planar element. This embodiment enables the outer surface of the first planar element, which then preferably represents the rear wall of the housing, to be of a smooth construction, which also reduces the risk of injury during transport of the first planar element. Since the condenser is integrated inside the first planar element, it is also protected from contamination.

According to a further variant of the modular refrigerating appliance according to the invention the condenser is in heat-conducting contact with the outer lining of the first planar element and/or is joined by foaming to the heat insulating material of the first planar element. Conditions are therefore provided for relatively good dissipation of heat from the condenser to the outside air during operation of the refrigerating appliance.

According to a further embodiment of the modular refrigerating appliance according to the invention the first planar element is provided on the outwardly directed lateral surface with an indentation whose depth is greater than the thickness of the condenser, and which is arranged in the condenser. Because the indentation is designed deeper than the thickness of the condenser, it is possible to fasten the condenser to the first planar element, which is preferably the rear wall, in such a manner that the condenser does not project from the indentation. The edging of the indentation therefore protects the condenser from mechanical damage. The condenser can be varnished on its visible side and an additional protective player layer can further protect the condenser from damage. An additional lining, which at least partially covers the indentation, can also provide improved protection of the condenser.

According to a preferred embodiment of the modular refrigerating appliance according to the invention the indentation is an open channel running along the rear wall.

According to a variant of the refrigerating appliance according to the invention a so- called wire needle, roll bond or tube-on-plate condenser is used as the condenser. Tube-on-plate heat transmitters comprise, for example, meandering metal and bent tubes which are connected by various technologies to a metal plate. Here the fitted metal plate may act as a rib and serve to transfer heat to the inner wall of the rear wall. Tube-on-plate late heat transmitters are sometimes also referred to as hot-wall heat transmitters.

According to a variant of the refrigerating appliance according to the invention the first planar element comprises a recess in which the compressor is fastened. If the first planar element is the rear wall, it can be designed very compactly if the recess is arranged in the lower region of the rear wall. The size of the recess is preferably adapted to the spatial expansions of the compressor. To enable the compressor to discharge exhaust heat to the area surrounding the assembled refrigerating appliance the recess is accessible from the outside of the housing according to an embodiment of the refrigerating appliance according to the invention. Since the compressor is fastened in the recess it does not project from the rear wall surrounding the recess, which means that the compressor is also protected from damage solely by the construction of the rear wall.

According to a further variant of the modular refrigerating appliance according to the invention the indentation at its lower end opens into the recess, thereby enabling air to flow upwards from the recess through the channel and cool the condenser.

According to a further advantageous embodiment of the modular refrigerating appliance according to the invention the condenser, which is preferably a spiral condenser, a tube-on-plate condenser or a wound wire tube condenser, is arranged in the recess.

According to a further embodiment of the modular refrigerating appliance according to the invention a ventilating device assigned to the condenser is provided for improved cooling of the condenser. The ventilating device can be arranged at the lower end of the indentation and/or in the recess. The ventilating device is a fan, for example. The ventilating device enables the condenser to be designed as small as possible, which also reduces the expansion of the indentation, for example.

The evaporator is particularly well protected when it is integrated in the first planar element, which is preferably the rear wall, as provided for according to a preferred embodiment of the modular refrigerating appliance according to the invention. This embodiment enables the inner surface of the first planar element to be designed smooth, thereby also reducing the risk of injury during transport of the first planar element. Since the evaporator is integrated within the first planar element it is also protected from contamination.

According to a further variant of the modular refrigerating appliance according to the invention the evaporator is in heat-conducting contact with the inner lining of the first planar element and/or is joined by foam to the heat insulating material of the first planar element. Conditions are therefore created for relatively good cooling of the housing of the refrigerating appliance.

According to a variant of the refrigerating appliance according to the invention a so-called roll-bond or tube-on-plate condenser is used as the evaporator. If tube-on-plate heat transmitters are also used both for the evaporator and for the condenser, they may be the same for the evaporator and condenser, which may in turn reduce the production costs of the refrigerating appliance according to the invention.

Alternatively a so-called lamellar evaporator in particular may also be used. A fan is preferably assigned to this evaporator.

In addition to the cooling circuit, a refrigerating appliance also comprises electronic components such as a regulating device for maintaining a theoretical temperature inside the refrigerating appliance. If the electricity for these electronic components is supplied from the rear wall, as provided for according to a further variant of the refrigerating appliance according to the invention, the cost of the electricity supply for the entire refrigerating appliance can be minimised and the refrigerating appliance can be designed as compactly as possible.

The refrigerating appliance according to the invention is provided in particular for being assembled by a customer himself, at home for example. In addition to a mechanical connection of the planar heat-insulating elements, it may also be necessary, according to the design, possibly to make electrical connections, e.g. an electrical cable from the refrigerating control to the cooling circuit. Such an electrical connection may be made relatively easily when, according to a preferred embodiment of the refrigerating appliance, an electrical contact device is integrated in the rear wall, which device electrically contacts an electrical counter-contact device integrated in this planar heat-insulating element automatically during the mechanical connection of the rear wall to a further planar heat-insulating element. Such a contact/counter-contact device is, for example, an electrical plug-socket connection. To ensure that the refrigerating appliance according to the invention has as few electrical connection points as possible, both the electricity supply for the electronic components and electrical control signals from the electronic components to the cooling circuit may be conducted by means of the electrical contact/counter-contact device.

If, according to a further variant of the refrigerating appliance according to the invention, all the electrical components are combined to form a single electronic unit, the number of electrical cables is reduced. The electronic components comprise, for example, a temperature sensor, the temperature electronics, a setting device for setting the theoretical temperature, or a lighting device for illuminating the interior of the housing. The electronic unit may, for example, be fastened to an inner side of one of the planar heat-insulating elements so that it is only accessible when the door of the refrigerating appliance is open. The electronic unit is suitably fastened to the ceiling element or to one of the lateral elements. In order to reduce the electricity consumption of the refrigerating appliance according to the invention, it may be advantageous for the lighting device to be switched on when the door of the refrigerating appliance is open and switched off when it is closed. The lighting device is switched on and off with a door opening switch, for example.

In order to reduce the cost of laying the electrical cables, for example, a channel for feeding through an electrical cable is integrated in at least one of the planar heat-insulating elements according to a further variant of the refrigerating appliance according to the invention. This channel may, for example, take the form of an empty tube or may also be provided for making a cooling circuit connection. The channel is advantageously laid in the planar heat-insulating element to which the electronic unit is also fastened. It is particularly advantageous for one of the channel to lead to the electronic unit and the other end of the channel to the counter-contact device, so that both the electricity supply for the electronic unit and the electrical cable for the electrical control signals transmitted from the electronic unit for the cooling circuit can be fed in the same channel. This results in a relatively clear, simple electrical cable routing. It is also advantageous for the channel to run in the rear wall and for one end of the channel to terminate at the electrical contact device so that the electricity supply for the electronic unit and the electrical cable for the electrical control signals transmitted from the electronic unit for the cooling circuit are in turn fed in this channel.

According to a further embodiment of the modular refrigerating appliance according to the invention, this appliance comprises a support device for receiving an inner device of the refrigerating appliance, which is part of the inner lining. A support device is, for example, a ribbed area for receiving shelves. The support device is preferably produced during a drawing or injection process for the inner lining surrounding the heat insulating material. In this embodiment the refrigerating appliance according to the invention is designed so that functional characteristics, e.g. the refrigerating appliance for receiving the shelf, are immanent. This renders an additional fastening of retaining parts for receiving added or equipment parts superfluous.

Figure 2:
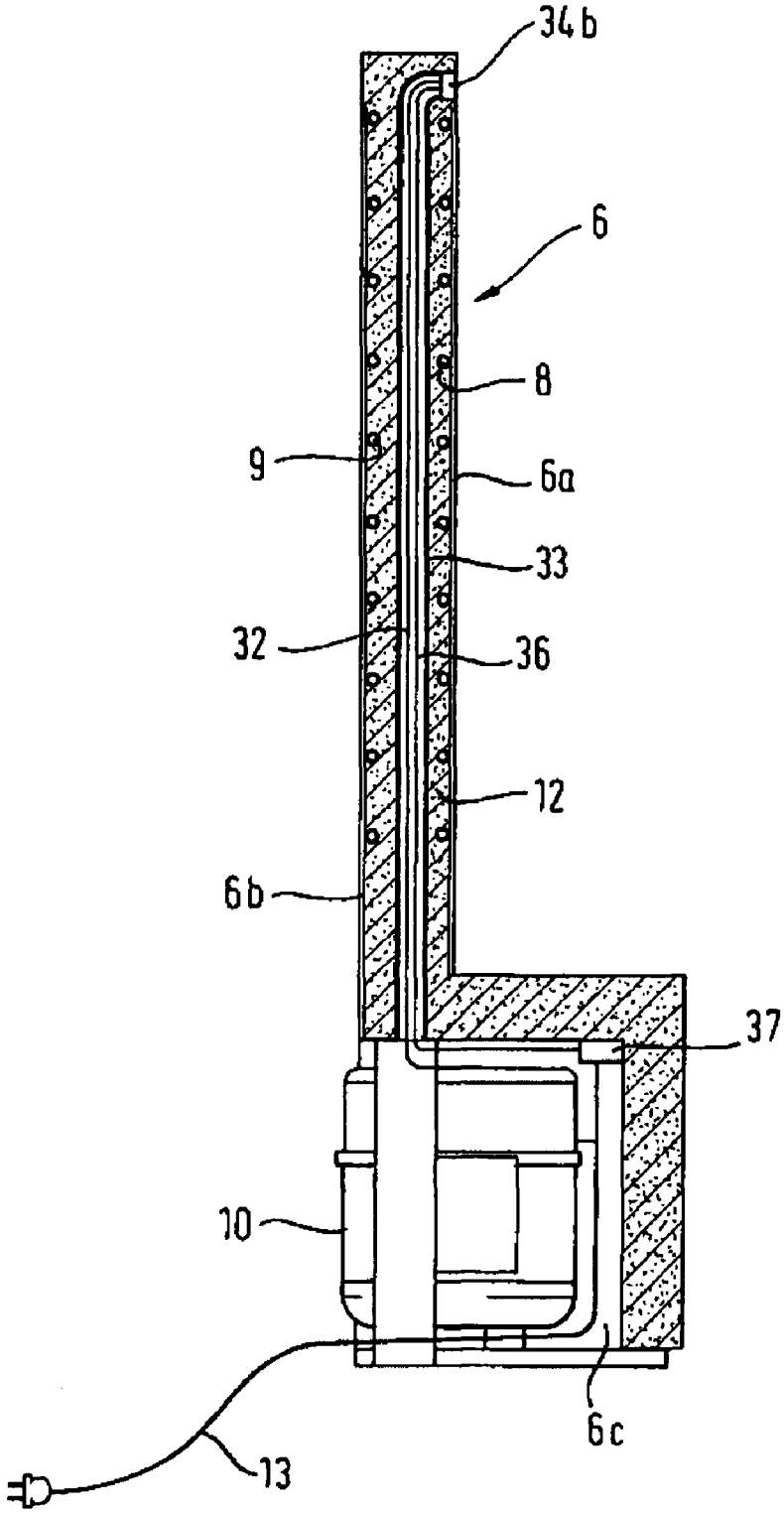
Figure 3:
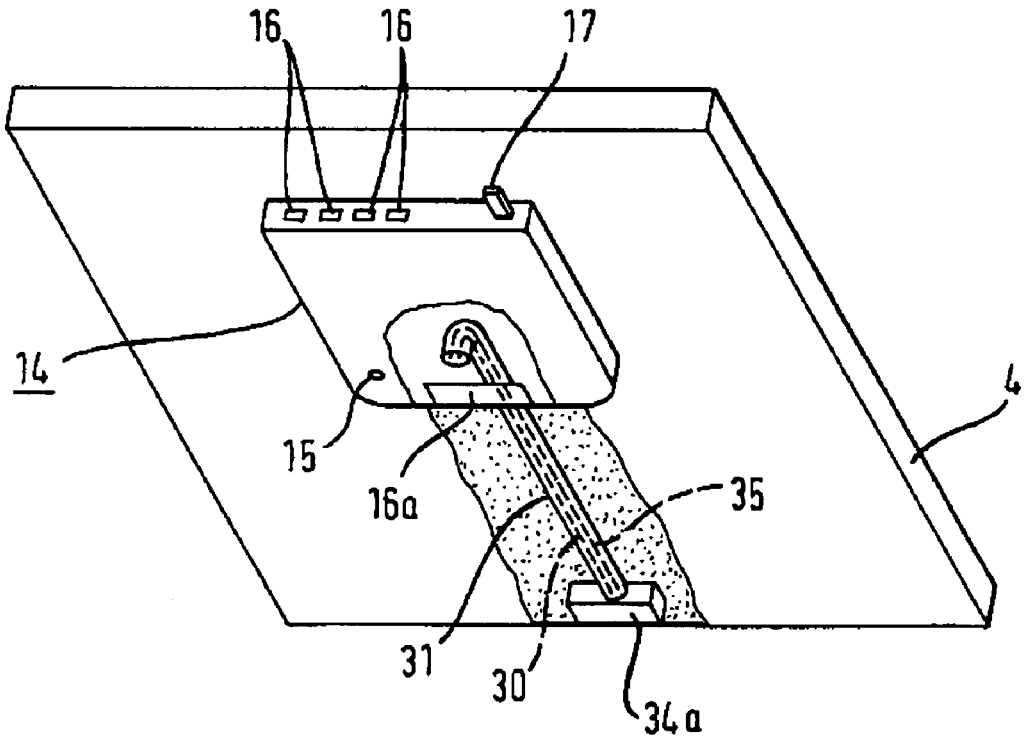
Figure 4:
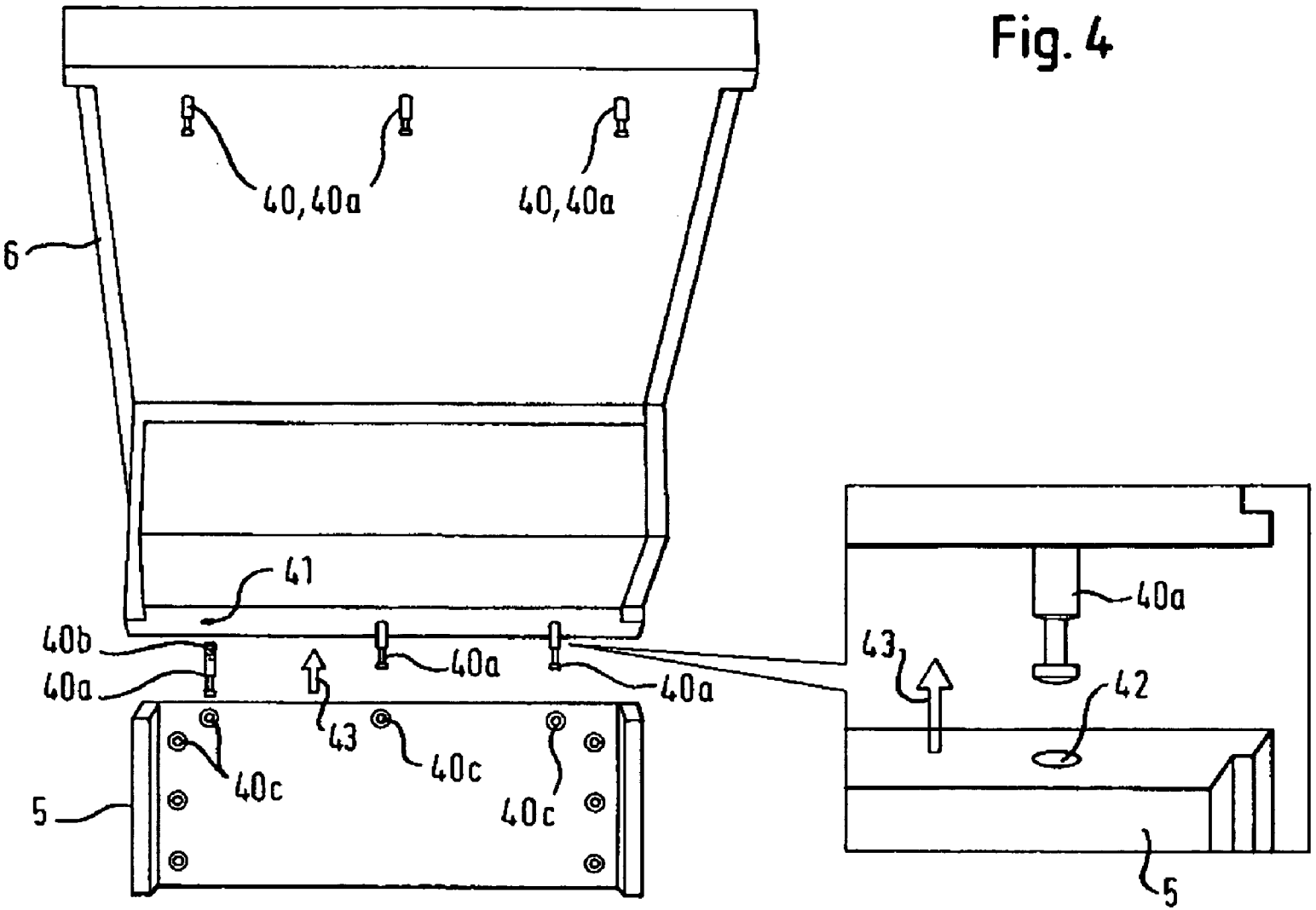
Figure 5:
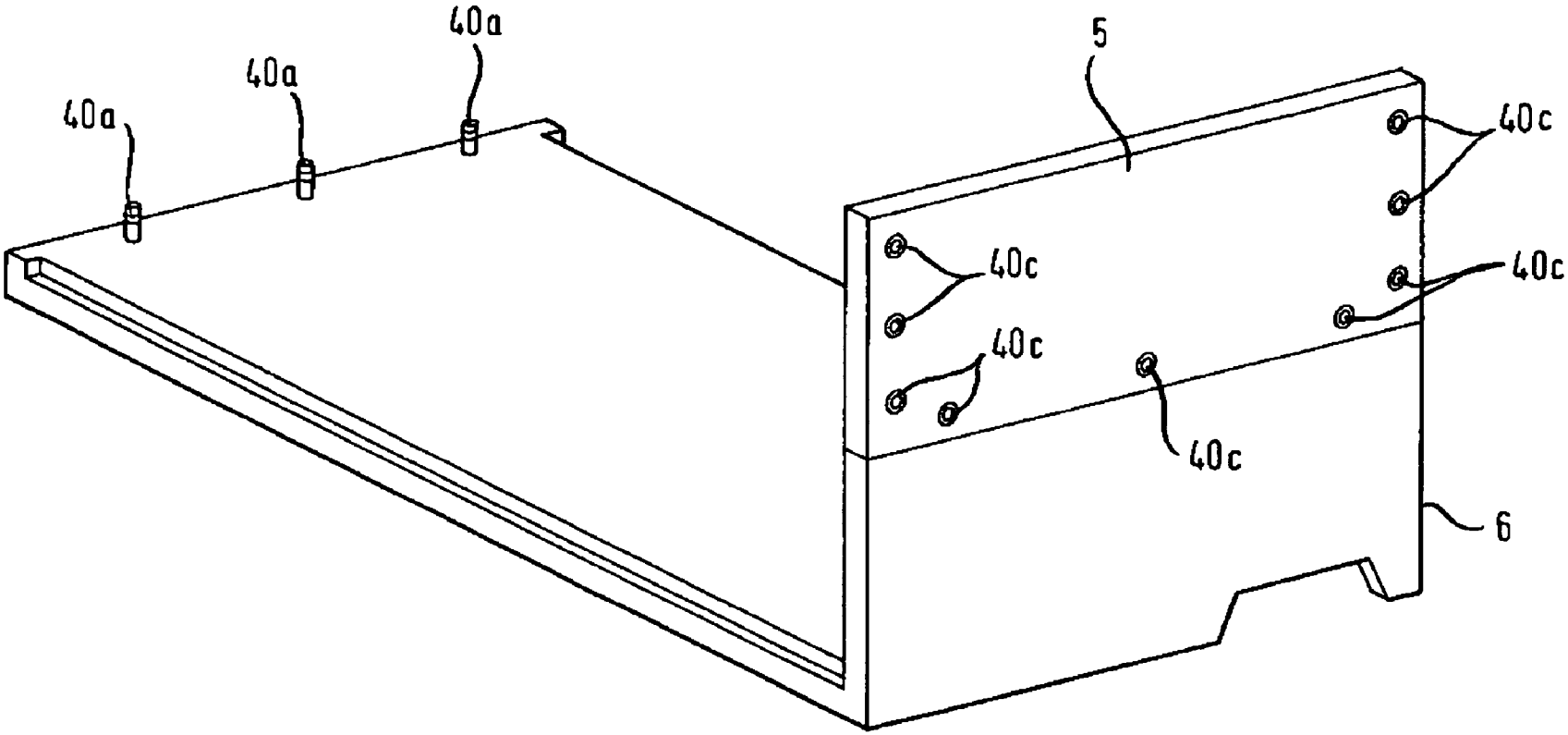
Figure 6:
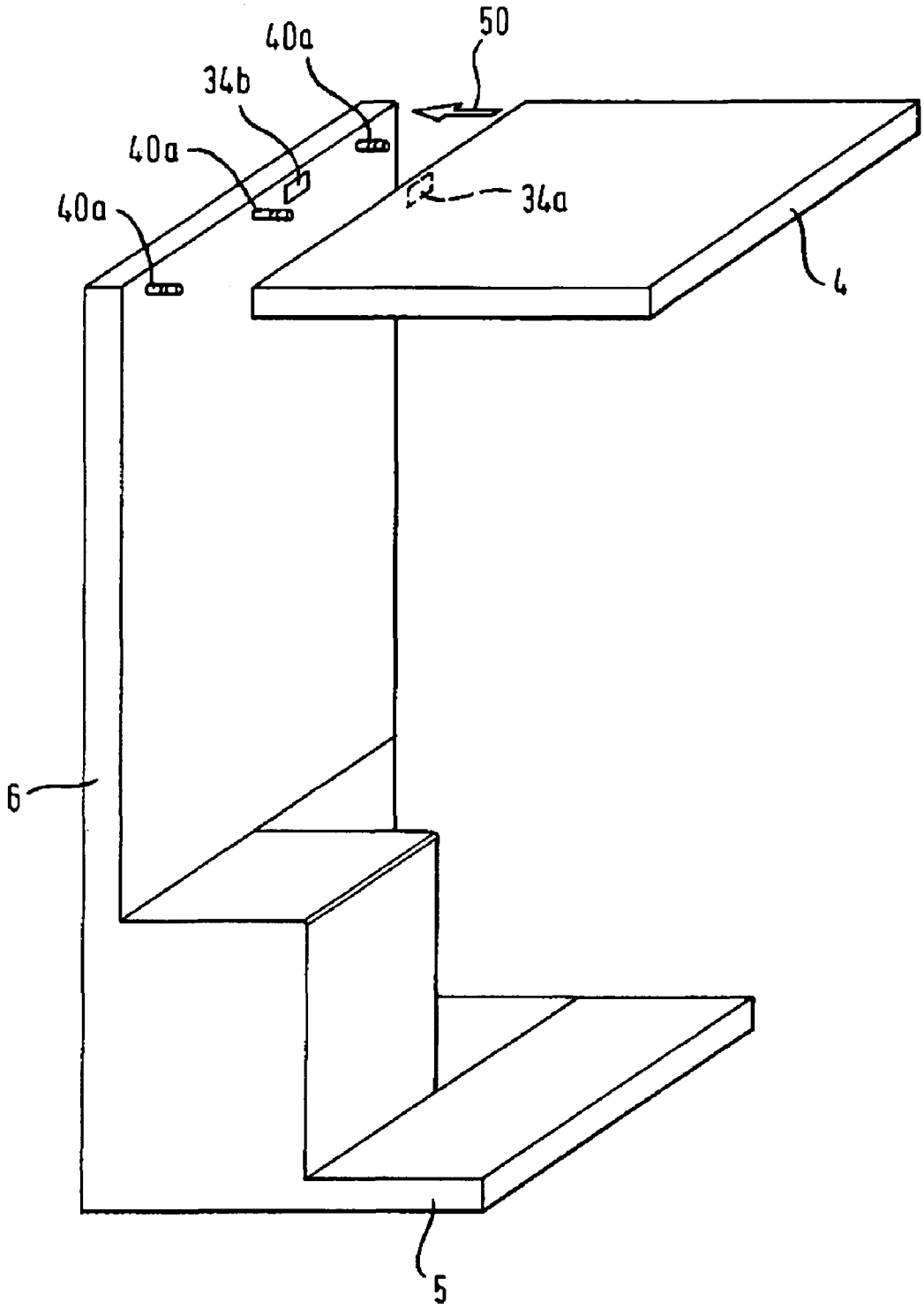
Figure 7:
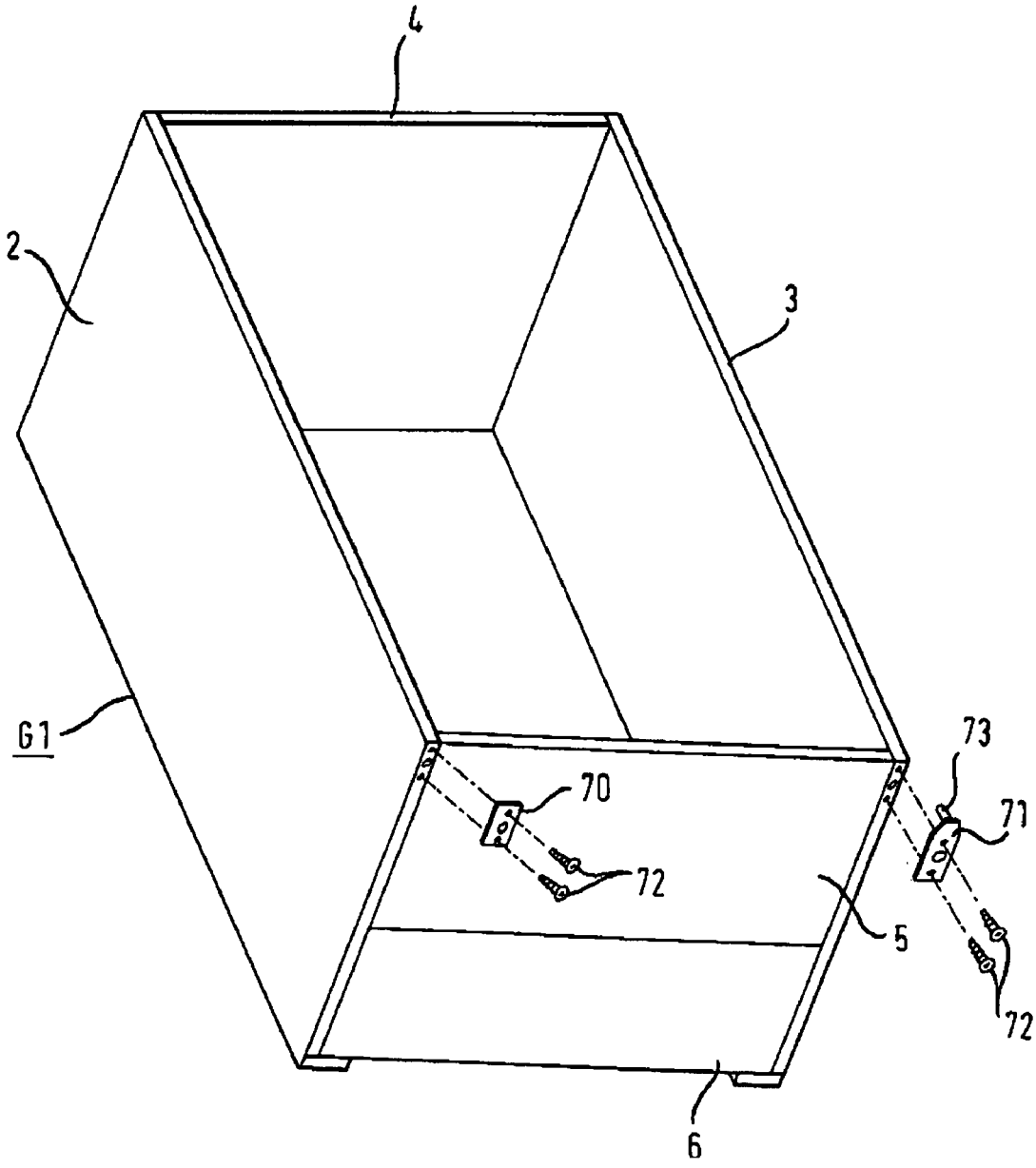
Figure 8:
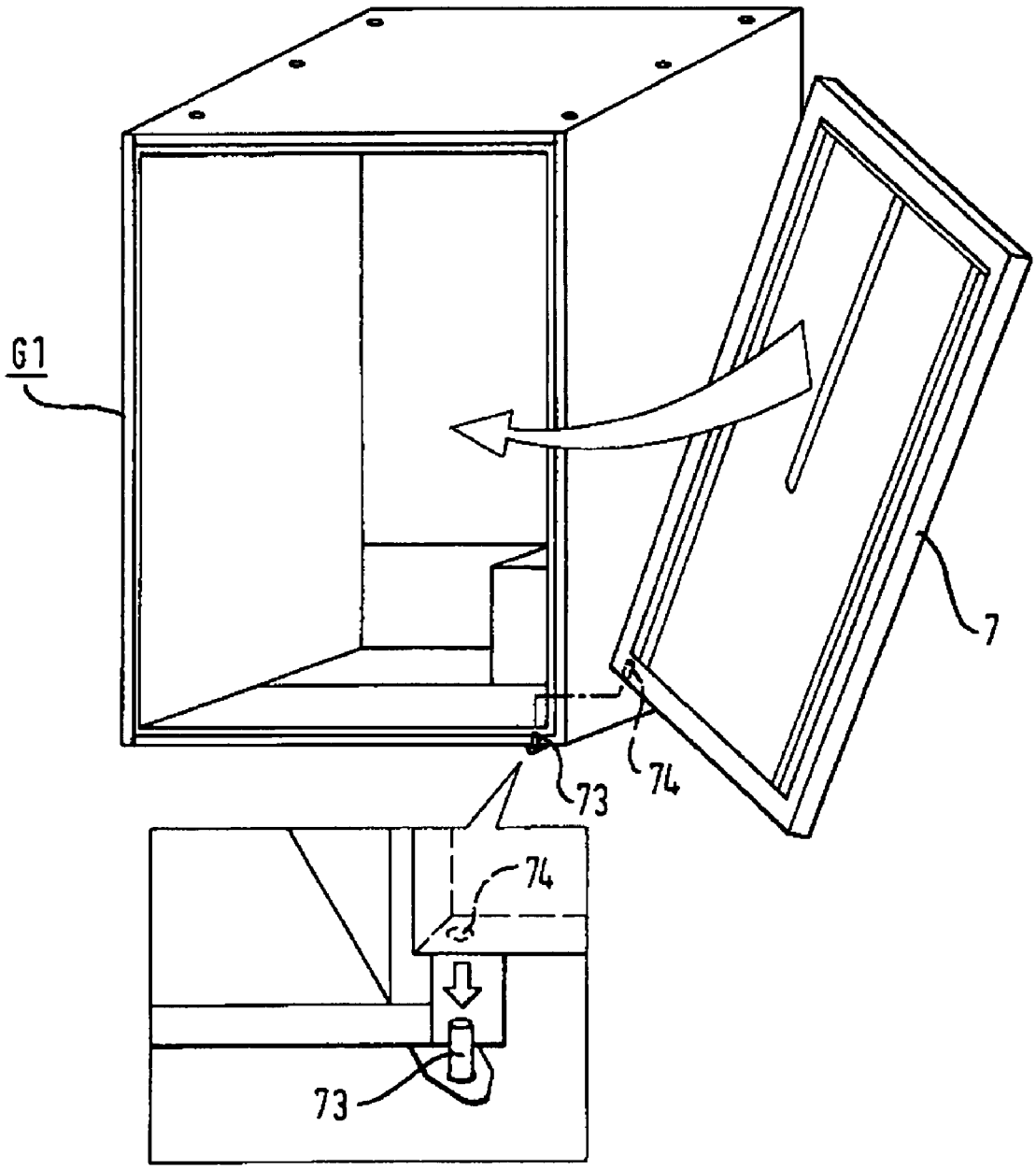
Figure 9:
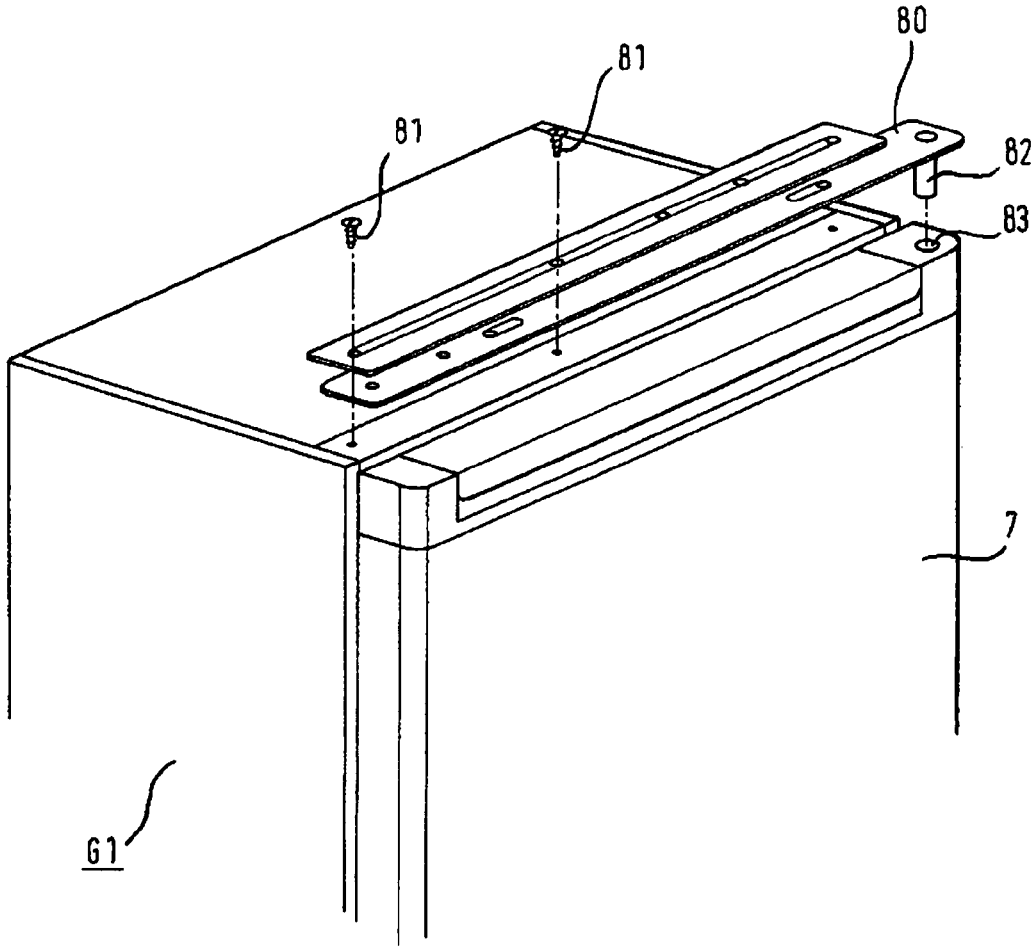
Figure 10:
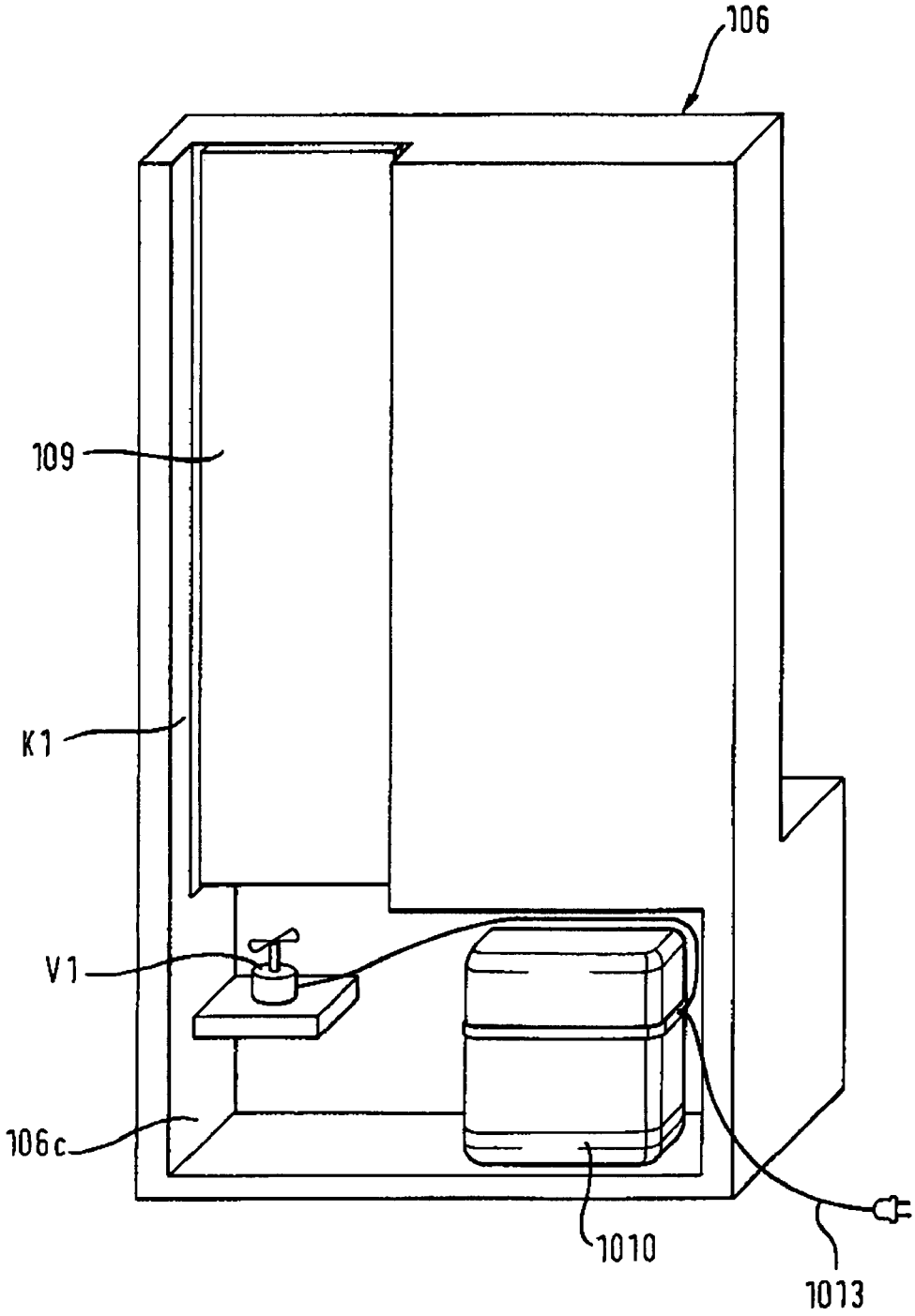
Figure 11:
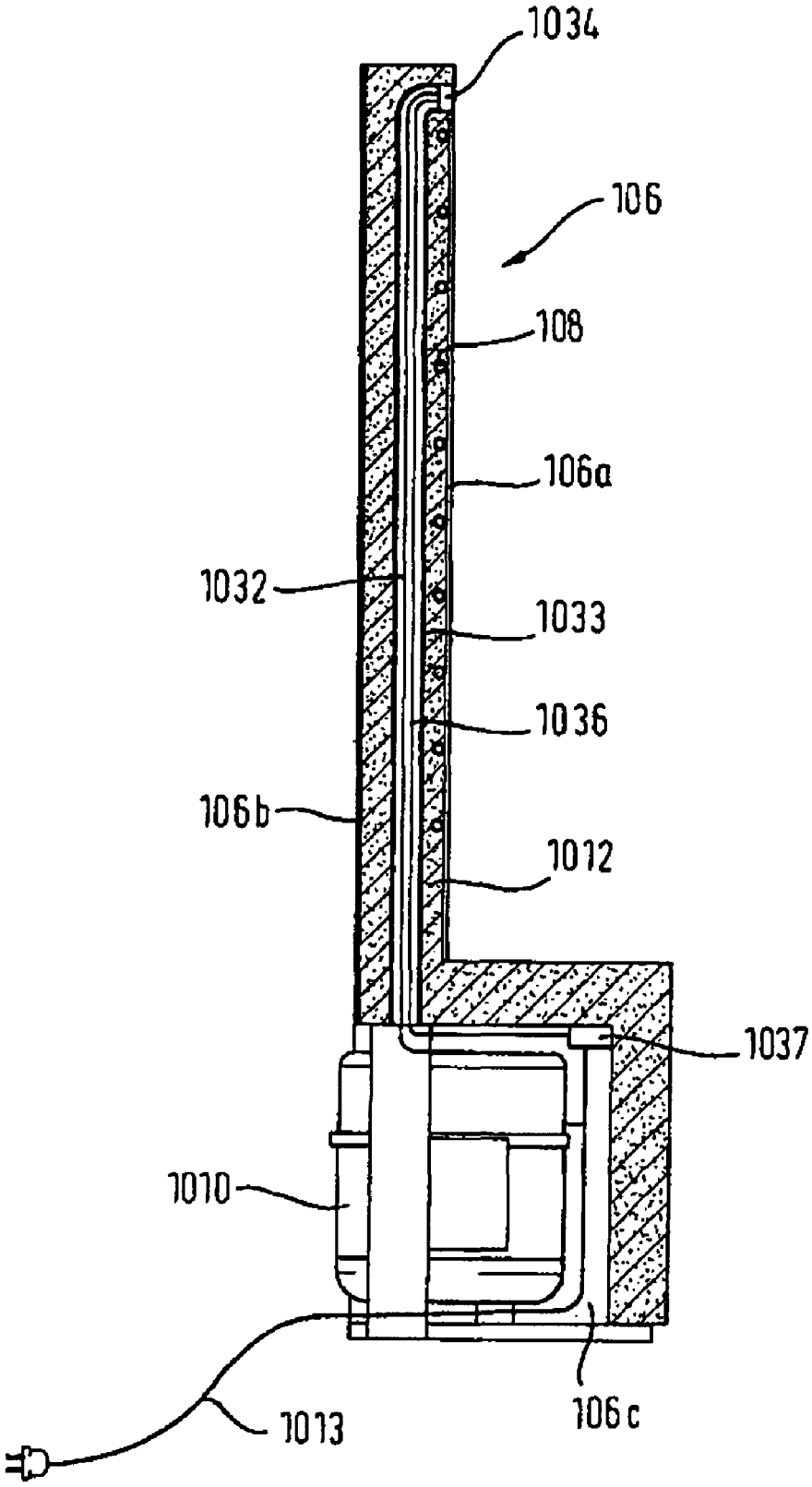
Figure 12:
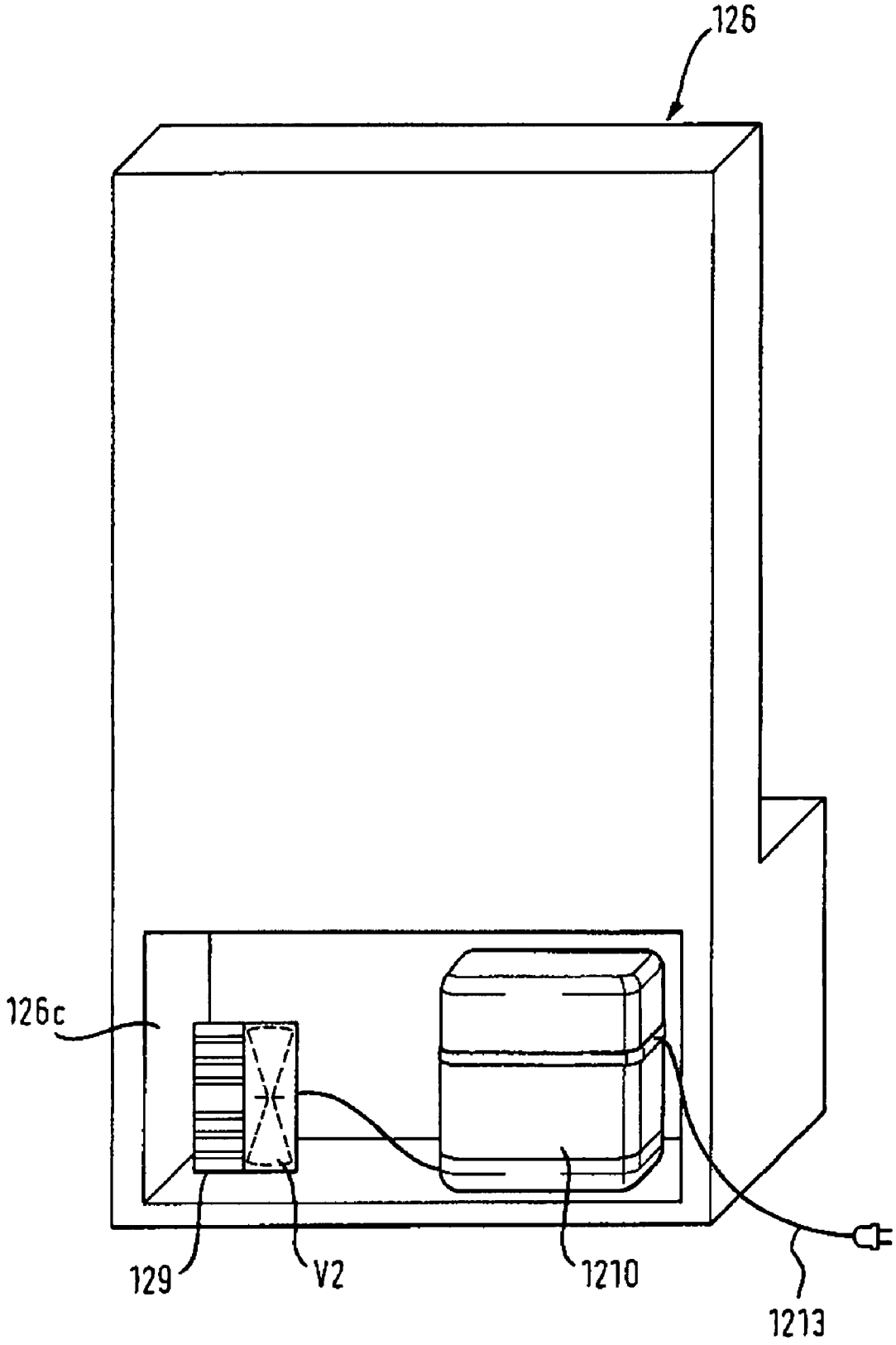
Figure 13:
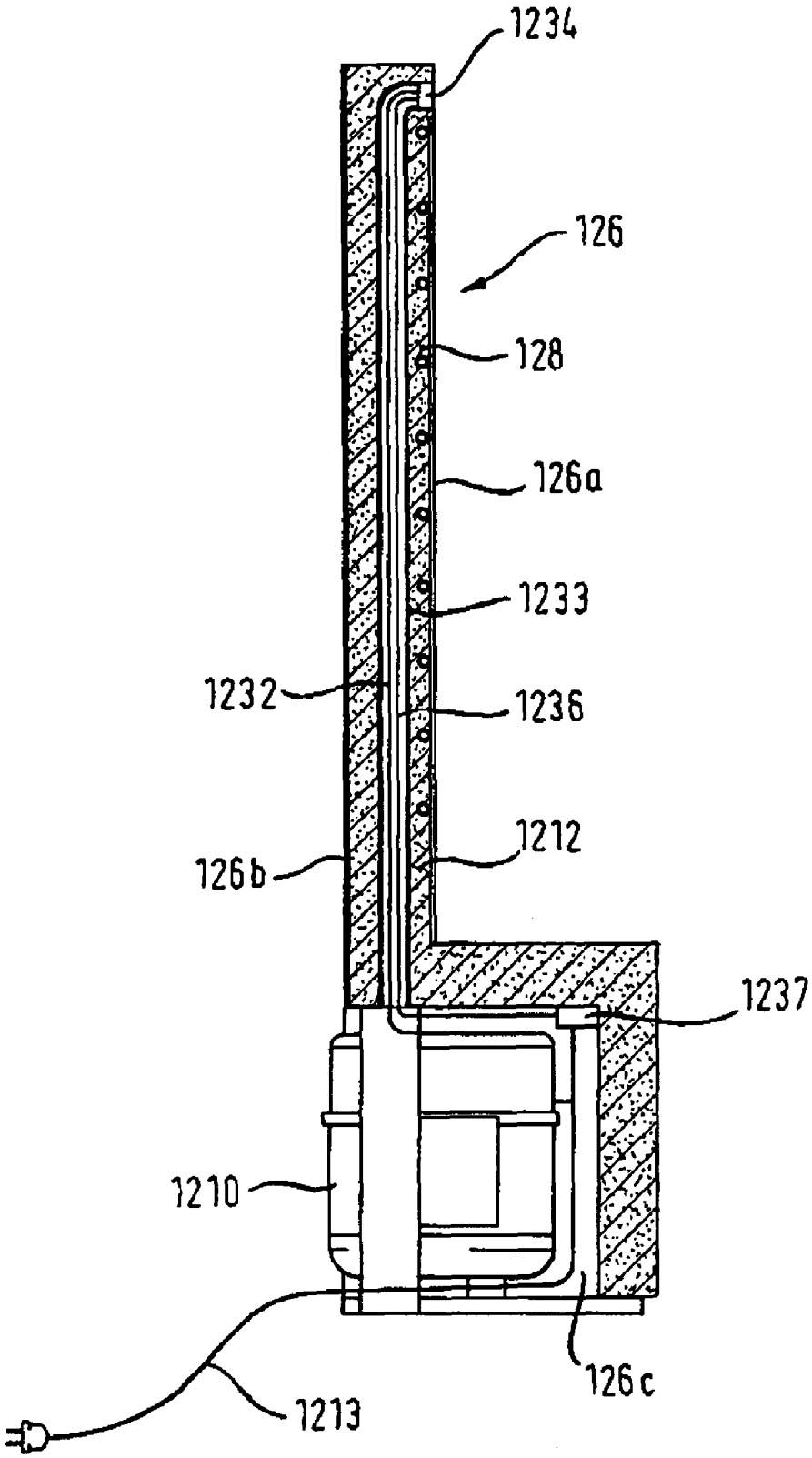
Figure 14:
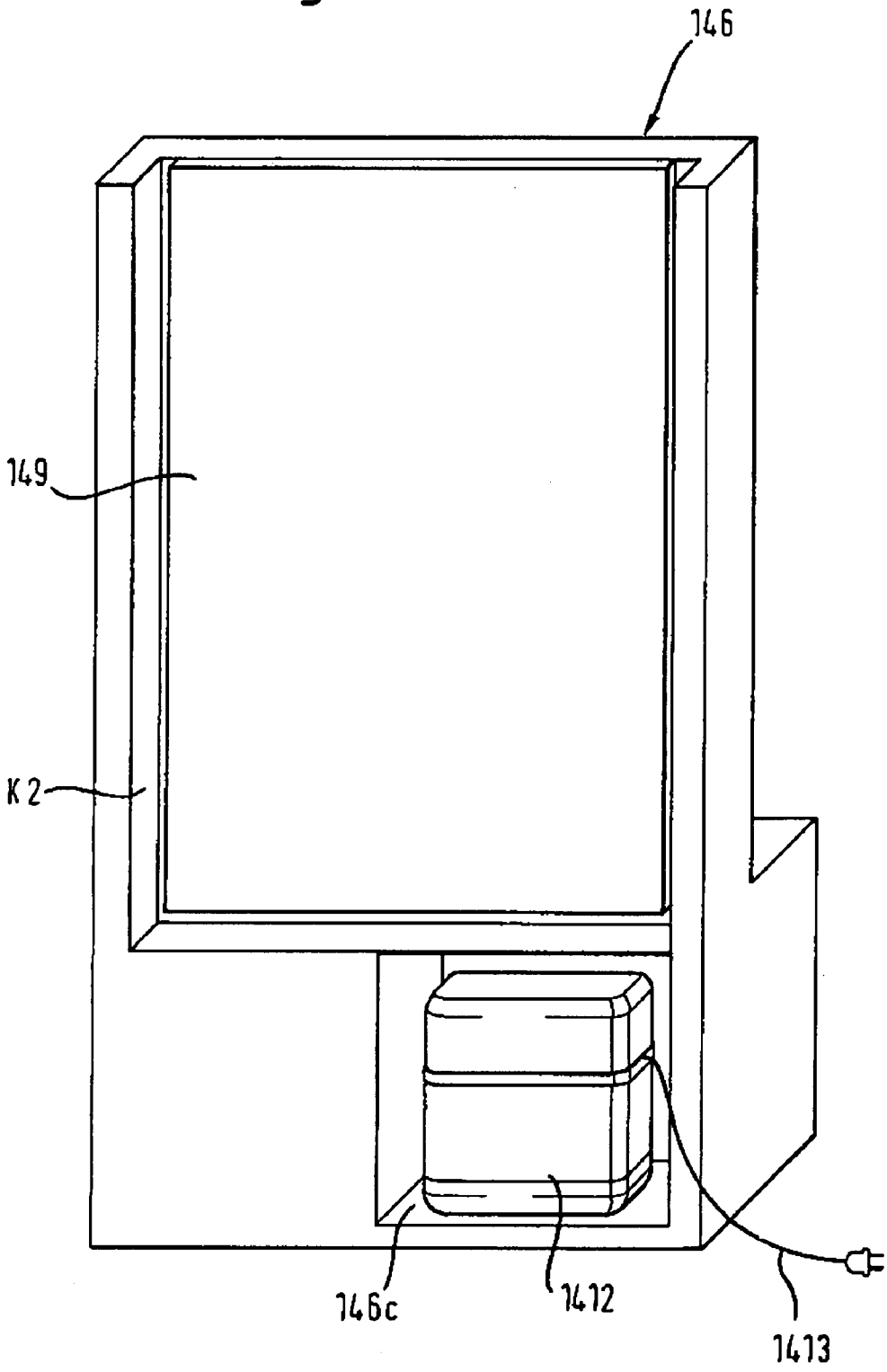
Figure 15:
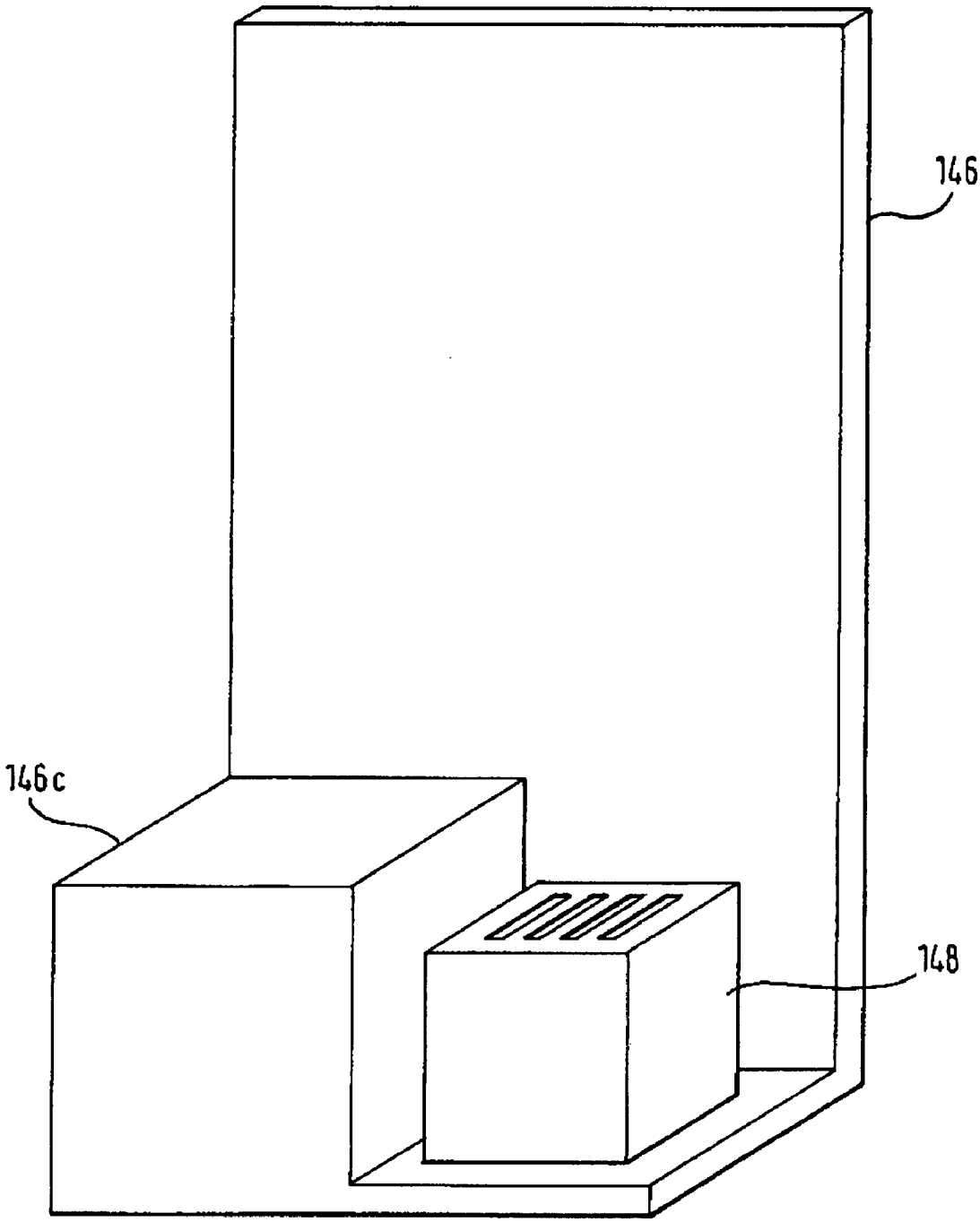
Figure 16:
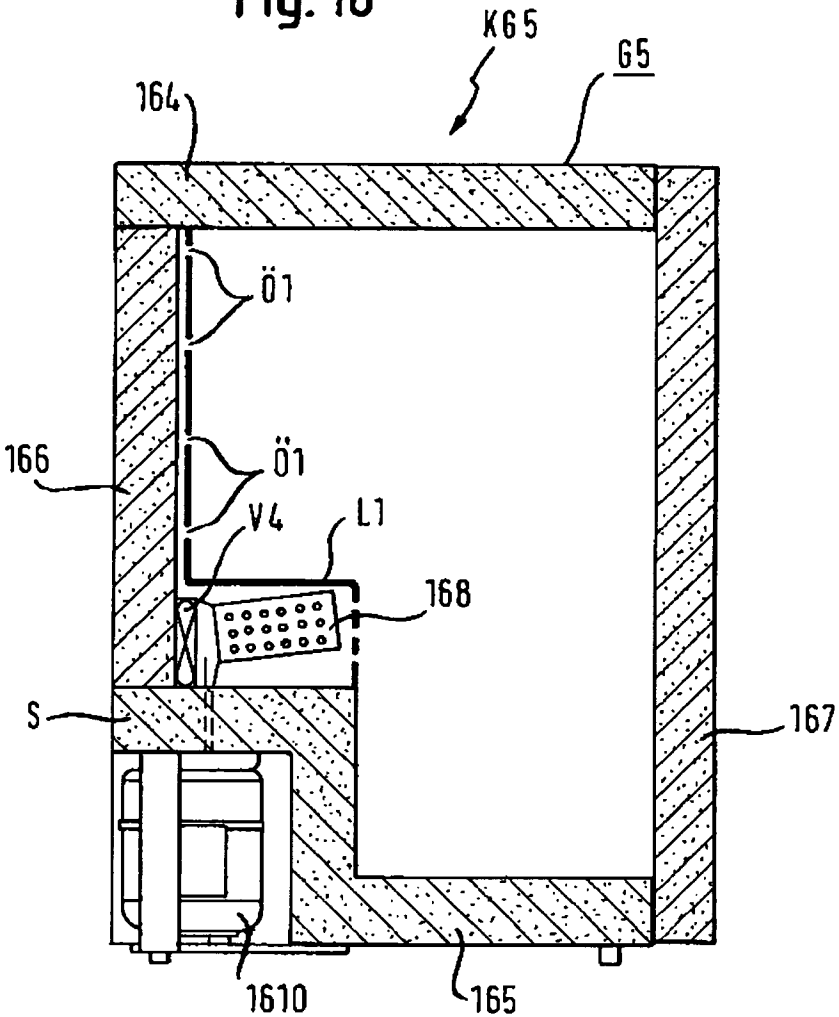
Figure 17:
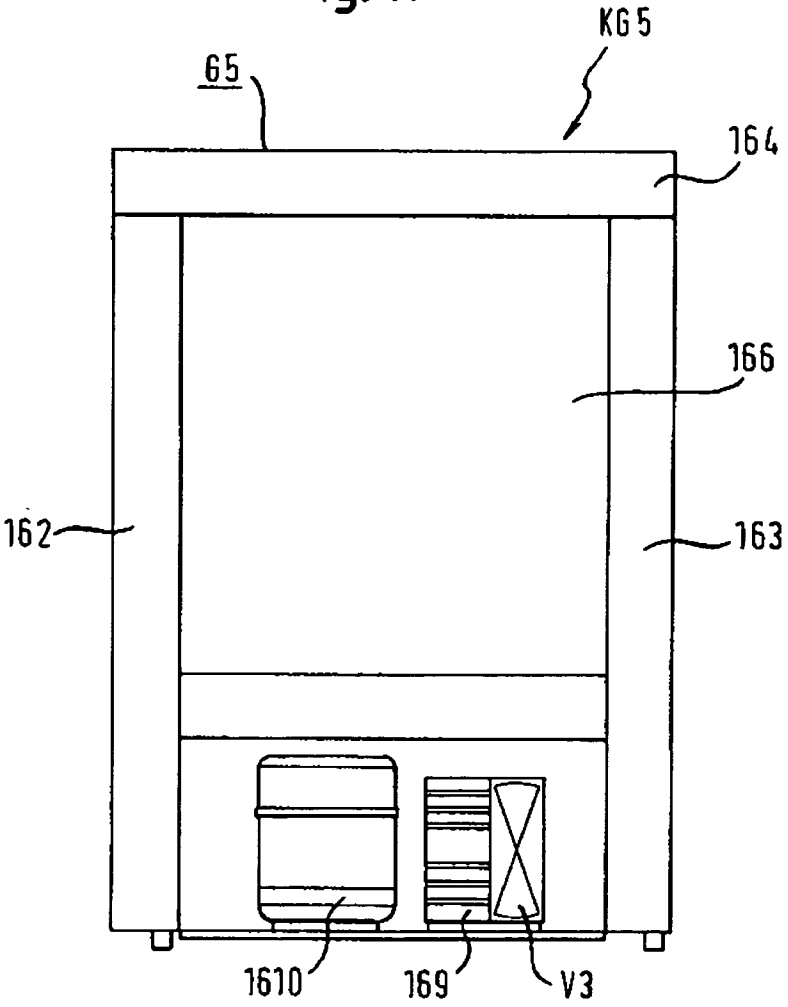
Figure 18:
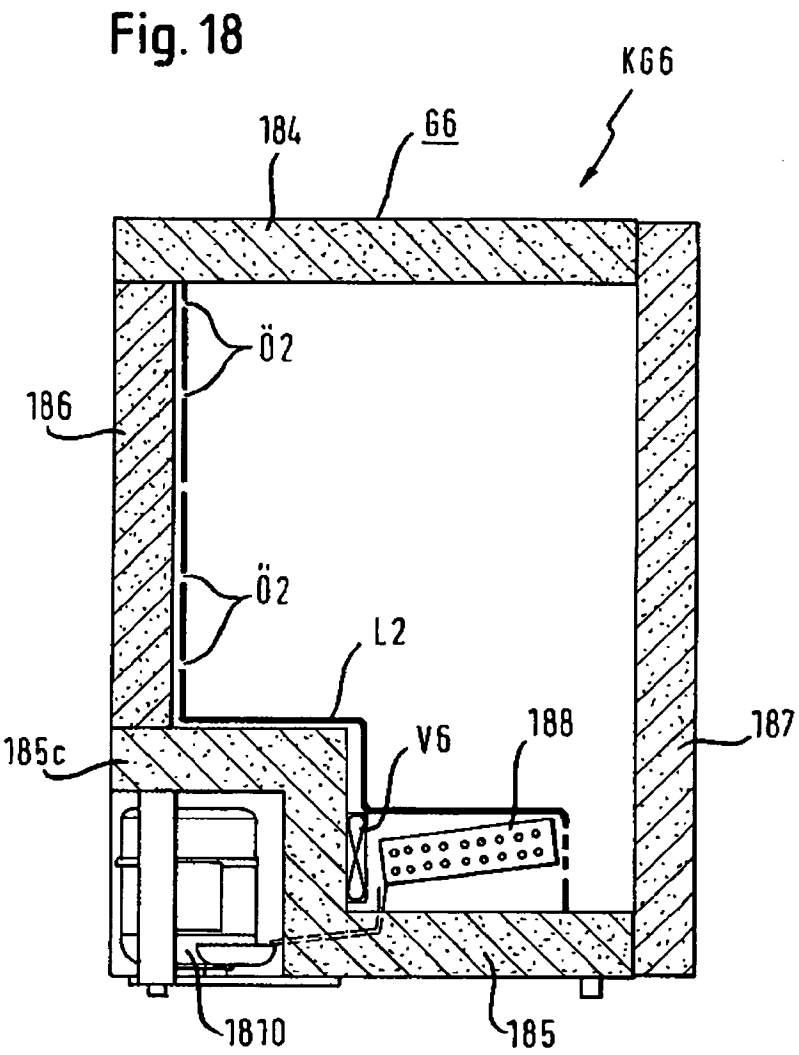
Figure 19:
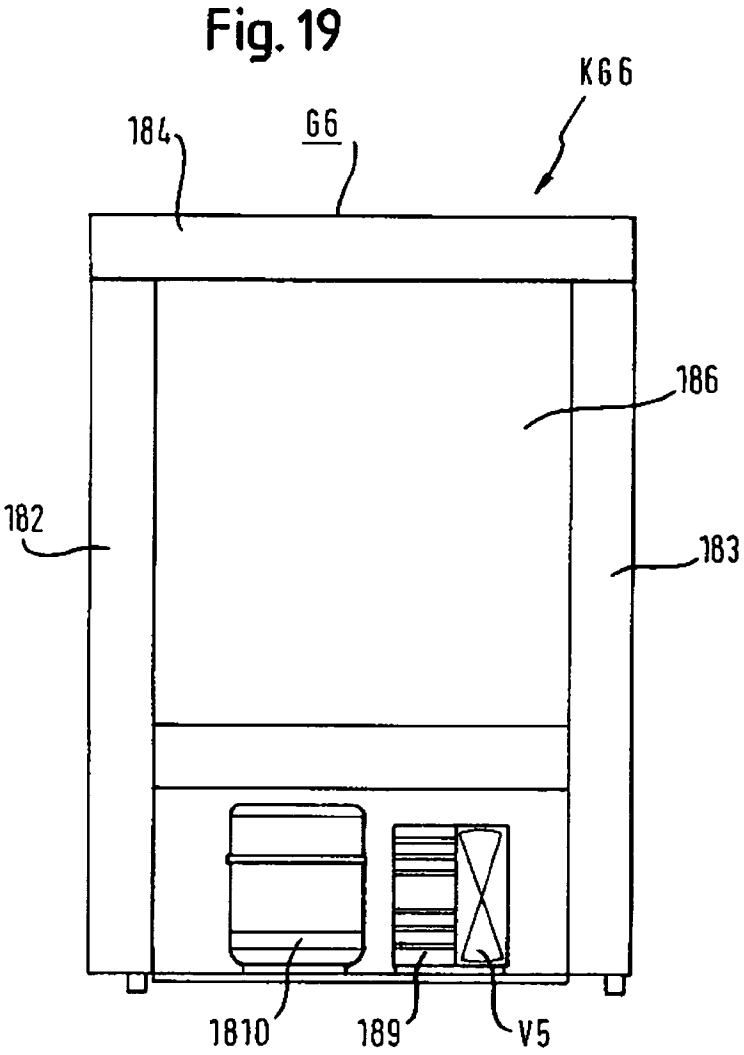

Exemplary embodiments of modular refrigerating appliances according to the invention are represented by way of example in the following diagrammatic figures, in which;

FIG. 1 shows a first exemplary embodiment of a modular refrigerating appliance when assembled, FIG. 2 shows the rear wall with the cooling circuit of the refrigerating appliance shown in FIG. 1, FIG. 3 shows the ceiling element with an electronic unit of the refrigerating appliance shown in FIG. 1, FIG. 4 shows the rear wall and the bottom element when detached from each other, FIG. 5 shows the rear wall and the bottom element, when joined together, FIG. 6 shows the rear wall, with the bottom element connected to it, and the ceiling element detached from it, FIG. 7 shows the finish assembled housing of the refrigerating appliance, FIG. 8 shows the housing and a door of the refrigerating appliance when not assembled, FIG. 9 shows the housing of the refrigerating appliance with partially assembled door, FIG. 10 shows an oblique view of a rear wall of a second exemplary embodiment of a modular refrigerating appliance, FIG. 11 shows a side view of the rear wall shown in FIG. 10, FIG. 12 shows a side view of a rear wall of a third exemplary embodiment of a modular refrigerating appliance, FIG. 13 shows an oblique view of the rear wall shown in FIG. 12, FIGS. 14 and 15 show oblique views of a rear wall of a fourth exemplary embodiment of a modular refrigerating appliance, FIG. 16 shows a side view of a modular refrigerating appliance according to a fifth embodiment when assembled, FIG. 17 shows a rear view of the modular refrigerating appliance shown in FIG. 16, FIG. 18 shows a side view of a modular refrigerating appliance according to a sixth embodiment when assembled, and FIG. 19 shows a rear view of the modular refrigerating appliance shown in FIG. 18.

FIG. 1 shows a first exemplary embodiment of a modular refrigerating appliance KG1 according to the invention when assembled and ready for operation. In the case of this exemplary embodiment, refrigerating appliance KG1 comprises two lateral walls 2 and 3, a ceiling element 4, a bottom element 5, a rear wall 6 and a door 7 which have been assembled together to form refrigerating appliance KG1. In this exemplary embodiment both lateral walls 2 and 3, ceiling element 4, bottom element 5 and rear wall 6 form housing G1 of refrigerating appliance KG1, which can be sealed with door 7. An inner device of refrigerating appliance KG1, e.g. drawers or shelves, are not shown in further detail in the figures. However, a ribbed area R for receiving shelves is shown. In the case of this exemplary embodiment ribbed area R was manufactured during a drawing or injection process of the inner lining of lateral walls 2 and 3 surrounding a heat-insulating material. Both lateral walls 2 and 3, ceiling element 4, bottom element 5, rear wall 6 and door 7 are connected to one another so that they can also be detached from each other.

Both lateral walls 2 and 3, ceiling element 4, bottom element 5, rear wall 6 and door 7 are designed as planar heat-insulating elements and in this exemplary embodiment each comprise an inner and outer lining which surround a cavity filled with a heat-insulating material. In this exemplary embodiment the heat-insulating material is an insulating foam 12. FIG. 2 shows in greater detail, by way of example, rear wall 6 with its inner lining 6*a* and its outer lining 6*b*.

Furthermore, the entire cooling circuit of refrigerating appliance KG1 is fastened to rear wall 6. The cooling circuit comprises essentially an evaporator 8, a condenser 9 and compressor 10, pipes connecting evaporator 8, condenser 9 and compressor 10, not shown in detail in the figures, and a refrigerant, not shown in detail. Both evaporator 8 and condenser 9, which in this exemplary embodiment are tube-on-plate heat transmitters of identical construction in this exemplary embodiment, are connected to the insulating foam 12 of rear wall 6. Evaporator 9 is in heat-conducting contact with inner lining 6*a*, and condenser 9 is in heat-conducting contact with outer lining 6*b*. Consequently condenser 9 is able to discharge its heat relatively well to the air surrounding refrigerating appliance KG1, and evaporator 8 is able to cool the interior of housing G1 of refrigerating appliance 1 relatively well. Therefore it is also possible to arrange as much insulating foam 12 as possible between evaporator 8 and condenser 9, as a result of which condenser 9 heats evaporator 8 as little as possible.

In this exemplary embodiment rear wall 6 comprises a recess 6*c* arranged in the lower region of rear wall 6, in which recess compressor 10 is fastened. Recess 6*c* is designed so that it is accessible from outside housing G1 of refrigerating appliance KG1, so that compressor 10 discharges its heat relatively well to the air surrounding housing G1. In this exemplary embodiment recess 6*c* does not extend over the entire width of housing G1. Compressor 10 is also supplied with electricity by means of mains cable 13.

In this exemplary embodiment the cooling circuit is tested before delivery of the disassembled refrigerating appliance KG1 and is fully functional, i.e. refrigerating appliance KG1 is ready for operation as soon as it is assembled and connected to an electricity mains.

In this exemplary embodiment refrigerating appliance KG1 comprises another electronic unit 14 in which all the electronic components of refrigerating appliance KG1 are assembled. Electronic unit 14 is shown in greater detail in FIG. 3. In this exemplary embodiment the electronic components comprise a regulating and control unit, not shown in detail, for regulating the inside temperature of refrigerating appliance KG1, a temperature sensor 15 required for this regulation, inputting means 16 for setting the desired theoretical temperature of refrigerating appliance KG1 and illumination 16*a* for illuminating the interior of housing G1. In this exemplary embodiment electronic unit 14 is fastened to the inner surface of ceiling element 4 and comprises a switch 17, which interacts with door 7 so that illumination 16*a* is switched on when door 7 is open and is switched off when door 7 is closed.

In order to regulate the temperature of refrigerating appliance 1, electronic unit 14 is electrically connected to compressor 10 when refrigerating appliance KG1 is assembled. In this exemplary embodiment this electrical connection comprises an electrical cable 30 which runs in a channel running in ceiling element 4 of refrigerating appliance KG1, which channel is in this exemplary embodiment is an empty tube 31, an electrical cable 32 which runs in a channel running in rear wall 6, which channel is in this exemplary embodiment an empty tube 33, and an electrical contact and counter-contact device, which in this exemplary embodiment is an electrical plug-socket device. Socket 34*a* of the plug-socket device is here fastened to ceiling element 4 and plug 34*b* of the plug-socket device is fastened to rear wall 6.

In this exemplary embodiment empty tube 33 is lathered in insulating foam 12 of rear wall 6 and empty tube 31 is lathered in the insulating foam of ceiling element 4. The one end of empty tube 31 integrated in ceiling element 4 leads to electronic unit 14, and the other end of empty tube 31 leads to socket 34*a*. The one end of empty tube 33 integrated in rear wall 6 leads to recess 6*c* and the other end of empty tube 33 leads to plug 34*b*. Electrical cable 30 running in empty tube 31 electrically connects electronic unit 14 to socket 34*a*, electrical cable 32 running in empty tube 33 connects compressor 10 electrically to plug 34*b*, and plug 34*b* and socket 34*a* are designed so that when assembled, electronic unit 14 is electrically connected to compressor 10 so that electronic unit 14 activates compressor 10 according to the set theoretical temperature and the actual temperature measured with temperature sensor 15.

An electricity supply provided for electronic unit 14, in the form of electrical cables 35 and 36, which are also laid in empty tubes 31 and 33 and are connected to one another by means of the plug-socket device. Power supply 37 required for establishing the low voltage is secured in recess 6*c* of rear wall 6 in this exemplary embodiment.

The assembly of refrigerating appliance KG1 is explained in more detail in the following with reference to FIGS. 4 to 9. To obtain housing G1 of refrigerating appliance 1, bottom element 5 and rear wall 6 are first connected to furniture fittings 40 in this exemplary embodiment. Furniture fittings 40 are designed so that bottom element 5 and rear wall 6 can also be detached from each, i.e. so that housing G1 can also be taken apart again. Some of furniture fittings 40 are shown in more detail in FIG. 4. FIG. 4, together with FIG. 5, also illustrate, by way of example, how rear wall 6 and bottom element 5 are connected to one another by means of some of furniture fittings 40.

In this exemplary embodiment furniture fittings 40 each comprise a metal pin 40*a*, which is provided with a thread 40*b*. In this exemplary embodiment thread 40*b* is screwed into holes 41 predrilled into rear wall 6 with a screwdriver, not shown. One of metal pins 40*a*' is shown in FIG. 4 still in the unscrewed condition. The remaining metal pins 40*a* shown in FIG. 4 are, on the other hand, shown already screwed into rear wall 6.

After metal pins 40*a* have been screwed into rear wall 6, bottom element 5, which in this exemplary embodiment comprises predrilled holes 42 corresponding to metal pins 40*a*, are fitted to rear wall 6 in the direction of arrows 43 so that metal pins 40*a* screwed in rear wall 6 are inserted into holes 42 of bottom element 5 corresponding to them. Metal pins 40*a* are then provided with lock nuts 40*c*, by means of the screwdriver, so that rear wall 6 and bottom element 5 are fixedly connected to one another, as shown in FIG. 5.

After bottom element 5 and rear wall 6 have been fixedly connected to one another by means of furniture fittings 40, further metal pins 40*a* are screwed into rear wall 6 in holes predrilled for this purpose. These screwed metal pins 40*a* are shown in FIG. 6 in the screwed condition. Ceiling element 4 is then presented to rear wall 6 in the direction of arrow 50 so that metal pins 40*a* are inserted into holes of ceiling element 4 corresponding to them, not shown in FIG. 6. By inserting metal pins 40*a* of rear wall 60 into the holes in ceiling element 4, socket 34*a* fastened to ceiling element 4 and plug 34*b* fastened to rear wall 6 are also aligned relative to one another so that they are automatically connected when ceiling element 4 and rear wall 6 are joined together, thus enabling the electrical contact to be made between compressor 10 and electronic unit 14. Finally metal pins 40*a* are also provided with lock nuts 40*c* so that rear wall 6 and ceiling element 4 are fixedly connected to one another.

Finally, in order to assembly housing G1 fully both lateral walls 2 and 3 are also connected to furniture fittings 40, rear wall 6, ceiling element 4 and bottom element 5. The fully assembled housing G1 is shown in FIG. 7.

Moreover, two further fittings 70 and 71 are each screwed with two screws 72 to the lower side of housing G1. One of fittings 71 is provided with a pin 73 to which door 7 of refrigerating appliance KG1 can be pivotably fastened. As illustrated in FIG. 8, door 7 is first placed on pin 73 of fitting 71 for fastening door 7 to housing G1. Door 7 has a suitable hole 74 for this purpose.

A further fitting 80 is then screwed on with screws 81 to the upper side of housing G1, as can be seen in FIG. 9. Fitting 80 comprises a pin 82, which is inserted into a further hole 83 of door 7.

FIGS. 10 and 11 show a rear wall 106 of a second exemplary embodiment of a modular refrigerating appliance according to the invention. This refrigerating appliance is constructed essentially as modular refrigerating appliance KG1 shown in FIGS. 1 to 9, except for rear wall 106. Therefore only rear wall 106 of the second exemplary embodiment is explained in more detail below. In this exemplary embodiment rear wall 106 also comprises an inner lining 106*a* and an outer lining 106*b*, which surround a cavity filled with a heat-insulating material. IN this exemplary embodiment this heat-insulating material is an insulating foam 1012.

The entire cooling circuit, comprising essentially an evaporator 108, a condenser 109, a compressor 1010 and pipes connecting evaporator 108, condenser 109 and compressor 1010, shown only in part in the figures, is also fastened to rear wall 106 of the second exemplary embodiment shown in FIGS. 10 and 11. Evaporator 108, which is a tube-on-plate heat transmitter in this exemplary embodiment, is joined to insulating foam 1012 in a similar manner to refrigerating appliance KG1 shown in FIGS. 1 to 9, and is in heat-conducting contact with inner lining 106*a*.

As shown in FIG. 10, rear wall 106 comprises an open channel K1 running on is outside and along rear wall 106, in which channel condenser 109, which in this exemplary embodiment is a wire needle condenser, is mounted. The open channel K1 running along rear wall 106 is designed so deep that condenser 109 does not project from the outside of rear wall 106. It is therefore possible to cover condenser 109 on the outside with a lining not shown in the figures. In this exemplary example the lining extends as far as the upper side of rear wall 106 and is screwed to rear wall 106.

Just as rear wall 6 of refrigerating appliance KG, rear wall 106 in this exemplary embodiment also comprises a recess 106*c* arranged in the lower region of rear wall 106, in which recess compressor 1010 is fastened. Recess 106*c* is designed so that it is accessible from outside the housing of the refrigerating appliance according to the second exemplary embodiment. In this exemplary embodiment recess 106*c* extends over the entire width of the housing. Compressor 1010 is also supplied with electricity by means of a mains cable 1013. Furthermore, open channel K1, running along rear wall 106, extends as far as recess 106*c* and the lining covering channel K1 extends as far as the upper edge of recess 106*c* in order to cover condenser 109 completely.

For better cooling of condenser 109 a fan V1 is in this exemplary embodiment fastened in recess 106*c* and below open channel K1 running along rear wall 106, which fan, when the refrigerating appliance according to the second exemplary embodiment is in operation, blows air from below to condenser 109. Due to the forced cooling of fan V1 it is possible to design condenser 109 with relatively small dimensions so that in this exemplary embodiment condenser 109 extends over approximately one third of the width of rear wall 106 and therefore the width of open channel K1 running along rear wall 106 is also approximately equal to one third of the width of rear wall 106.

Similarly to the case of rear wall 6 of the first exemplary embodiment of modular refrigerating appliance KG1, a channel in the form of an empty tube 1033 runs inside rear wall 106 of the refrigerating appliance according to the second exemplary embodiment, in which tube are laid an electrical cable 1032 for activating compressor 1010 and an electrical cable 1036 for supplying electricity to electronic unit 14. Moreover, a plug 1034*b* is fastened to rear wall 106, to which plug electrical cables 1032 and 1036 are connected. When assembled, electronic unit 14 is therefore electrically connected to compressor 1010. Power supply 1037 required for generating the low voltage is in this exemplary embodiment fastened in recess 106*c* of rear wall 106.

FIGS. 12 and 13 show a rear wall 126 according to a third exemplary embodiment of a modular refrigerating appliance according to the invention. This refrigerating appliance is constructed essentially the same as modular refrigerating appliance KG1 shown in FIGS. 1 to 9, except for rear wall 126, thus only rear wall 126 of the refrigerating appliance according to the third exemplary embodiment will be explained in more detail in the following. In this exemplary embodiment rear wall 126 comprises an inner lining 126*a* and an outer lining 126*b*, each of which surrounds a cavity filled with heat-insulating material. In this exemplary embodiment the heat-insulating material is an insulating foam 1212.

The entire cooling circuit is also fastened to rear wall 126 of the third exemplary embodiment of a refrigerating appliance, shown in FIGS. 12 and 13, this circuit comprising essentially an evaporator 128, a condenser 129, a compressor 1210 and pipes, represented only partially in the figures, connecting evaporator 128, condenser 129 and compressor 1210. Evaporator 128, which is a tube-on-plate heat transmitter in this exemplary embodiment, is joined by foam to insulating foam 121, just as evaporators 9 and 109 of the two refrigerating appliances according to the first and second exemplary embodiments, and is in heat-conducting contact with inner lining 126*a*.

Similarly to rear wall 6 of refrigerating appliance KG1, rear wall 106 comprises in this exemplary embodiment a recess 126*c* arranged in the lower region of rear wall 136, in which recess compressor 1210 and condenser 129 are fastened. However, in this exemplary embodiment recess 126*c* extends over the entire width of the housing of the refrigerating appliance according to the third exemplary embodiment. Compressor 1210 is also supplied with electricity by means of a mains cable 1213.

Condenser 129 is in this exemplary embodiment a spiral condenser which is force cooled with a fan V2.

Similarly to rear wall 6 of the first exemplary embodiment of modular refrigerating appliance KG1, a channel runs inside rear wall 126 in the form of an empty tube 1233 in which are laid an electrical cable 1232 for activating compressor 1210 and an electrical cable 1236 for supplying electronic unit 14 with electricity. Moreover, a plug 1234*b*, to which electrical cables 1232 and 1236 are connected, is fastened to rear wall 126. When assembled electronic unit 14 is therefore electrically connected to compressor 1210. Power supply 1237 required to generate the low voltage is in this exemplary embodiment fastened in recess 126*c* of rear wall 126.

FIGS. 14 and 15 show a rear wall 146 of a fourth exemplary embodiment of a modular refrigerating appliance according to the invention. This refrigerating appliance is essentially of the same construction as modular refrigerating appliance KG1 shown in FIGS. 1 to 9, except for rear wall 146, thus only rear wall 146 of the fourth exemplary embodiment is explained in more detail in the following. Similarly to rear walls 6, 106 and 126 of the exemplary embodiments described above, rear wall 146 comprises in this exemplary embodiment an inner lining and an outer lining, not shown in more detail in the figures, which linings surround a cavity filled with a heat-insulating material, not shown in further detail either. In this exemplary embodiment the heat-insulating material is an insulating foam.

As shown in FIG. 14, rear wall 146 comprises an open channel 2 running on its outside and along rear wall 146, in which channel is mounted a condenser 19, which in this exemplary embodiment is a wire needle condenser. Open channel 2 running along rear wall 146 is designed so deep that condenser 149 does not project from the outside of rear wall 146. It is therefore possible to cover condenser 149 on the outside with a lining not shown in the figures. In this exemplary embodiment the lining extends as far as the upper side of rear wall 146 and is screwed to rear wall 146.

Unlike condenser 109 of the second exemplary embodiment, condenser 149 is not force cooled in the fourth exemplary embodiment, which is why condenser 149 is designed with larger dimensions than condenser 109 in the second exemplary embodiment and extends approximately over the entire width of rear wall 149. Channel K2 therefore also extends approximately over the entire width of rear wall 149. Alternatively, however, condenser 149 of the fourth exemplary embodiment may also be force cooled with a fan, just as condenser 149 in the second exemplary embodiment.

Rear wall 146 also comprises, in this exemplary embodiment, a recess 146*c* in which is fastened a compressor 1410. Recess 146*c* extends in this exemplary embodiment over approximately half the entire width of rear wall 146. Recess 1462 is designed so that it is accessible from outside the housing of the refrigerating appliance according to the fourth exemplary embodiment. Compressor 1410 is also supplied with electricity by means of a mains cable 1413.

The cooling circuit in the fourth exemplary embodiment comprises a lamellar evaporator 148 with a fan integrated in the upper part of lamellar evaporator 148. Lamellar evaporator 148, with the fan, is also secured in recess 146*c* on rear wall 146, as shown in FIG. 15. When the refrigerating appliance in the fourth exemplary embodiment is assembled, lamellar evaporator 148 is arranged inside the housing of this refrigerating appliance. The air to be cooled when the refrigerating appliance ready for use is in operation is sucked in through openings underneath lamellar evaporator 148. The fan of lamellar evaporator 148 blows the air cooled by lamellar evaporator 148 back into the interior of the housing.

Similarly to rear wall 6 in the first exemplary embodiment of modular refrigerating appliance KG1, a channel not shown, runs inside rear wall 146 in the form of an empty tube in which are laid an electrical cable for activating compressor 1410 and an electrical cable for supplying electronic unit 14 with electricity. Moreover, a plug, not shown in more detail, to which the electrical cables are connected, is fastened to rear wall 146. When assembled, electronic unit 14 is therefore electrically connected to compressor 1410. The power supply required for generating the low voltage is in this exemplary embodiment fastened in recess 146*c* of rear wall 146, and is not shown in more detail either.

FIGS. 16 and 17 show a fifth exemplary embodiment of a modular refrigerating appliance KG5 when assembled. Refrigerating appliance KG5 comprises in this exemplary embodiment two lateral walls 162 and 163, a ceiling element 164, a bottom element 165, a rear wall 166, a door 167 and a base element S1, which have been assembled to form refrigerating appliance KG1. Both lateral walls 162 and 163, ceiling element 164, bottom element 165, rear wall 166 and base element S1 form in this exemplary embodiment housing G5 of refrigerating appliance KG5, which can be sealed with door 167. An inner device of refrigerating appliance KG1, e.g. drawers or shelves, are not shown in further detail in the figures. Refrigerating appliance KG5 also comprises a ribbed area, not shown in more detail, similar to ribbed area R of refrigerating appliance KG1 shown in FIGS. 1 to 9. Both lateral walls 162 and 163, ceiling element 164, bottom element 165, rear wall 166, base element S1 and door 16 are connected to one another so that they can again be detached from one another.

Both lateral walls 162 and 163, ceiling element 164, bottom element 165, rear wall 166, base element S and door 167 are designed as planar heat-insulating elements and in this exemplary embodiment each comprise an inner and an outer lining which surround a cavity filled with a heat-insulating material.

Base element S is constructed similarly to recess 106*c* of the refrigerating appliance according to the second exemplary embodiment. A compressor 1610 and a spiral condenser 169, which is force cooled dynamically with a fan V3, is fastened in base element S.

The cooling circuit of refrigerating appliance KG5 comprises a lamellar evaporator 168, which is fastened to base element S. When refrigerating appliance KG5 is assembled, lamellar evaporator 168 is arranged inside housing G5. The air to be cooled in the operation of the ready to use refrigerating appliance KG5 is sucked in through openings on the front side of lamellar evaporator 168. For uniform air distribution these openings should be formed so that the flow resistance is at its maximum in the centre and decreases towards the outside. A radial fan V4 deflects the air horizontally sucked in to a vertical discharge with little loss in this exemplary embodiment. In addition, an air distributor device L1 is provided in this exemplary embodiment which distributes the cold air of lamellar evaporator 168 through openings Ö1 in air distributor device L1 into the interior of housing G5.

FIGS. 18 and 19 show a sixth exemplary embodiment of a modular refrigerating appliance KG6 when assembled. In this exemplary embodiment refrigerating appliance KG6 comprises two lateral walls 182 and 183, a ceiling element 184, a bottom element 185, a rear wall 186 and a door 187, which have been assembled to form refrigerating appliance KG6. Both lateral walls 182 and 183, ceiling element 184, bottom element 185 and rear wall 186 form in this exemplary embodiment housing G6 of refrigerating appliance KG6, which can be sealed with door 187. An inner device of refrigerating appliance KG6, e.g. drawers or shelves, are not shown in more detail in the figures. Refrigerating appliance KG6 also comprises a ribbed area, not shown in more detail, similar to ribbed area R of refrigerating appliance KG1 shown in FIGS. 1 to 9. Both lateral walls 182 and 183, ceiling element 184, bottom element 185, rear wall 186 and door 187 are connected to one another so that they can also be detached from one another again.

Both lateral walls 182 and 183, ceiling element 184, bottom element 185, rear wall 186 and door 187 are designed as planar heat-insulating elements and in this exemplary embodiment each comprise an inner an outer lining which surround a cavity filled with a heat-insulating material.

Bottom element 185 comprises, in its rear section, a recess 185*c*, which is constructed similarly to base element S of refrigerating appliance KG5. A compressor 1810 and a spiral condenser 189, which is dynamically force cooled with fan V5, is fastened in recess 185*c*. The cooling circuit of refrigerating appliance KG6 comprises a lamellar evaporator 188, which is fastened to bottom element 185. When refrigerating appliance KG6 is assembled, lamellar evaporator 188 is arranged inside housing G6. The air to be cooled when ready to use refrigerating appliance KG6 is in operation is sucked in through openings on the front side of lamellar evaporator 188. For uniform air distribution these openings should be formed so that the flow resistance is at its maximum in the centre and decreases towards the outside. In this exemplary embodiment a radial fan V6 deflects the air horizontally sucked in to a vertical discharge with little loss. IN addition, an air distributor device L2 is provided in this exemplary embodiment which distributes the cold air of lamellar evaporator 188 through openings Ö2 in air distributor device L2 into the interior of housing G6

The invention claimed is:

1. A modular refrigerating appliance comprising a first planar heat-insulating element and additional planar heat-insulating elements, which can be connected to one another and again detached from one another, and, when connected, form a housing of the refrigerating appliance, and also having a cooling circuit comprising an evaporator, a condenser and a compressor, the cooling circuit being arranged on the first planar heat-insulating element, wherein solely due to the construction of the first planar heat-insulating element, the condenser is at least partially mechanically protected on its surface directed away from the first planar heat-insulating element.

2. The modular refrigerating appliance according to claim 1, wherein the first heat-insulating element comprises an inner lining and an outer lining which surround a cavity filled with a heat-insulating material.

3. The modular refrigerating appliance according to claim 2, wherein the condenser is integrated in the first planar element.

4. The modular refrigerating appliance according to claim 2, wherein the condenser is in heat-conducting contact with the outer lining of the first planar element and/or is joined by foam to the heat-insulating material of the first planar element.

5. The modular refrigerating appliance according to claim 1, wherein the first planar element is provided on a lateral surface facing outwards with an indentation whose depth is greater than a thickness of the condenser and wherein the condenser is arranged in the indentation.

6. The modular refrigerating appliance according to claim 5, wherein the indentation is covered at least in part with a lining.

7. The modular refrigerating appliance according to claim 1, wherein the first planar element is a rear wall of the housing of the refrigerating appliance.

8. The modular refrigerating appliance according to claim 7, wherein the first planar element is provided on a lateral surface facing outwards with an indentation whose depth is greater than a thickness of the condenser and wherein the condenser is arranged in the indentation, the indentation being an opening channel running along the rear wall.

9. The modular refrigerating appliance according to claim 1, wherein the condenser includes a so-called wire needle, roll-bond or tube-on-plate condenser.

10. The modular refrigerating appliance according to claim 1, wherein the first planar element comprises a recess in which the compressor is fastened.

11. The modular refrigerating appliance according to claim 10, wherein the condenser is arranged in the recess.

12. The modular refrigerating appliance according to claim 11, wherein the condenser includes a spiral condenser.

13. The modular refrigerating appliance according to claim 10, wherein the recess is accessible from outside the housing.

14. The modular refrigerating appliance according to claim 10, wherein the first planar element is provided on a lateral surface facing outwards with an indentation whose depth is greater than the thickness of the condenser and is arranged in the condenser, wherein the indentation opens at its lower end into the recess.

15. The modular refrigerating appliance according to claim 1, wherein the refrigerating appliance has a ventilating device assigned to the condenser.

16. The modular refrigerating appliance according to claim 15, wherein the first planar element is provided on a lateral surface facing outwards with an indentation whose depth is greater than the thickness of the condenser and is arranged in the condenser, wherein the ventilating device is arranged at the lower end of the indentation.

17. The modular refrigerating appliance according to claim 15, wherein the first planar element comprises a recess in which the compressor is fastened, the ventilating device being arranged in the recess.

18. The modular refrigerating appliance according to claim 1, wherein the evaporator is integrated in the first planar heat-insulating element.

19. The modular refrigerating appliance according to claim 18, wherein the evaporator is at least one of being in heat-conducting contact with the inner lining of the first planar heat-insulating element and being joined by foam to the heat insulating material of the first planar heat-insulating element.

20. The modular refrigerating appliance according to claim 1, wherein the evaporator includes at least one of a tube-on-plate evaporator and a roll-bond evaporator.

21. The modular refrigerating appliance according to claim 1, further comprising electronic components, wherein the electricity supply for the electronic components of the refrigerating appliance derives from the first heat-insulating element.

22. The modular refrigerating appliance according to claim 1, wherein an electrical contact device is integrated in the first heat-insulating element, which device, during the mechanical connection of the first planar heat-insulating element to one of the additional planar heat-insulating elements, automatically and electrically contacts an electrical counter-contact device integrated in the one of the additional planar heat-insulating elements.

23. The modular refrigerating appliance according to claim 1, further comprising electronic components, wherein all of the electronic components of the refrigerating appliance are assembled together to form one electronic unit.

24. The modular refrigerating appliance according to claim 1, wherein a channel is integrated in at least one of the planar heat-insulating elements for carrying out an electrical conduction or a cooling circuit connection.

25. The modular refrigerating appliance according to claim 2, wherein a support device for receiving an inner device of the refrigerating appliance is part of the inner lining.

26. The modular refrigerating appliance according to claim 23, wherein the support device includes a ribbed area for receiving shelves.

27. The modular refrigerating appliance according to claim 23, wherein the support device is produced during a drawing or injection process for the inner lining surrounding the heat-insulating material.

28. A modular refrigerating appliance comprising:

an insulated housing including:

a first planar heat-insulating element;

a second planar heat-insulating element configured to be connected and detached from the first planar heat-insulating element;

wherein, when the first planar heat-insulating element is connected to the second planar heat-insulating element, the first planar heat-insulating element and the second planar heat-insulating element form at least a portion of the insulated housing of the refrigerating appliance, wherein the first planar heat-insulating element includes a cooling circuit having an evaporator, a condenser and a compressor, wherein the cooling circuit is arranged on the first planar heat-insulating element, and wherein the first planar heat-insulating element at least partially mechanically protects a surface of the condenser that is directed away from the first planar heat-insulating element.

29. The modular refrigerating appliance of claim 28, wherein the first planar heat-insulating element comprises an inner lining and an outer lining which surround a cavity filled with a heat-insulating material, wherein the condenser is integrated in the heat-insulating material of the first planar heat-insulating element and is in heat-conducting contact with the outer lining of the first planar heat-insulating element.

30. The modular refrigerating appliance of claim 28, wherein the first planar heat-insulating element is a rear wall of the insulated housing of the refrigerating appliance, wherein the first planar heat-insulating element includes a recess, wherein the compressor is fastened in the recess, wherein the first planar heat-insulating element includes a lateral surface facing outwards with an indentation whose depth is greater than a thickness of the condenser, wherein the indentation is a channel running along the rear wall, the channel having a lower end that opens into the recess, and wherein the condenser is in the channel.

* * * * *